US009966671B2

(12) United States Patent
Tombak et al.

(10) Patent No.: US 9,966,671 B2
(45) Date of Patent: May 8, 2018

(54) HIGH ISOLATION DUAL ANTENNA RF SWITCH ARCHITECTURES

(71) Applicant: RF Micro Devices, Inc., Greensboro, NC (US)

(72) Inventors: Ali Tombak, Santa Clara, CA (US); Marcus Granger-Jones, Scotts Valley, CA (US)

(73) Assignee: Qorvo US, Inc., Greensboro, NC (US)

( * ) Notice: Subject to any disclaimer, the term of this patent is extended or adjusted under 35 U.S.C. 154(b) by 492 days.

(21) Appl. No.: 14/613,105

(22) Filed: Feb. 3, 2015

(65) Prior Publication Data

US 2015/0222026 A1 Aug. 6, 2015

Related U.S. Application Data

(60) Provisional application No. 61/935,090, filed on Feb. 3, 2014.

(51) Int. Cl.
*H01Q 3/24* (2006.01)
*H01Q 21/28* (2006.01)
*H01Q 1/52* (2006.01)

(52) U.S. Cl.
CPC ..... *H01Q 21/28* (2013.01); *H01Q 1/523* (2013.01)

(58) Field of Classification Search
CPC ..... H01Q 3/24; H01Q 1/20; H01Q 21/28; H01Q 1/243; H01Q 9/0407
USPC ..... 343/876, 814, 904, 854, 777
See application file for complete search history.

(56) References Cited

U.S. PATENT DOCUMENTS

2012/0139363 A1* 6/2012 Kerr ..... H04B 1/006 307/115
2013/0252562 A1* 9/2013 Hasson ..... H04B 1/44 455/78

* cited by examiner

*Primary Examiner* — Dameon E Levi
*Assistant Examiner* — Collin Dawkins
(74) *Attorney, Agent, or Firm* — Withrow & Terranova, P.L.L.C.

(57) ABSTRACT

RF circuitry, which includes a first main RF switching circuit and a second main RF switching circuit, is disclosed. The first main RF switching circuit is capable of providing an RF signal path between a first main RF port and a first selected one of a first RF antenna and a second RF antenna. The second main RF switching circuit is capable of providing an RF signal path between a second main RF port and a second selected one of the first RF antenna and the second RF antenna. The first main RF switching circuit includes a first pair of RF switches coupled in series between the first RF antenna and the first main RF port; a second pair of RF switches coupled in series between the second RF antenna and the first main RF port; a first shunt RF switch; and a second shunt RF switch.

21 Claims, 15 Drawing Sheets

HIGH ISOLATION DUAL ANTENNA RF SWITCH ARCHITECTURES

RELATED APPLICATIONS

The present application claims the benefit of U.S. provisional patent application No. 61/935,090, filed Feb. 3, 2014, and is hereby incorporated herein by reference in its entirety.

FIELD OF THE DISCLOSURE

Embodiments of the present disclosure relate to radio frequency (RF) communications systems, which may include RF front-end circuitry, RF transceiver circuitry, RF transmit circuitry, RF receive circuitry, RF diplexers, RF duplexers, RF filters, RF antennas, RF switches, RF combiners, RF splitters, the like, or any combination thereof.

BACKGROUND

As wireless communications technologies evolve, wireless communications systems become increasingly sophisticated. As such, wireless communications protocols continue to expand and change to take advantage of the technological evolution. As a result, to maximize flexibility, many wireless communications devices must be capable of supporting any number of wireless communications protocols, each of which may have certain performance requirements, such as specific out-of-band emissions requirements, linearity requirements, or the like. Further, portable wireless communications devices are typically battery powered and need to be relatively small, and have low cost. As such, to minimize size, cost, and power consumption, RF circuitry in such a device needs to be as simple, small, flexible, and efficient as is practical. Thus, there is a need for RF circuitry in a communications device that is low cost, small, simple, flexible, and efficient.

SUMMARY

RF circuitry, which includes a first main RF switching circuit and a second main RF switching circuit, is disclosed according to one embodiment of the present disclosure. The first main RF switching circuit is capable of providing an RF signal path between a first main RF port and a first selected one of a first RF antenna and a second RF antenna. The second main RF switching circuit is capable of providing an RF signal path between a second main RF port and a second selected one of the first RF antenna and the second RF antenna. The first main RF switching circuit includes a first pair of RF switches, a second pair of RF switches, a first shunt RF switch, and a second shunt RF switch. The first pair of RF switches are coupled in series between the first RF antenna and the first main RF port. The second pair of RF switches are coupled in series between the second RF antenna and the first main RF port. The first shunt RF switch is coupled between a connection to both of the first pair of RF switches and a ground. The second shunt RF switch is coupled between a connection to both of the second pair of RF switches and the ground.

Those skilled in the art will appreciate the scope of the disclosure and realize additional aspects thereof after reading the following detailed description in association with the accompanying drawings.

BRIEF DESCRIPTION OF THE DRAWINGS

The accompanying drawings incorporated in and forming a part of this specification illustrate several aspects of the disclosure, and together with the description serve to explain the principles of the disclosure.

DETAILED DESCRIPTION

The embodiments set forth below represent the necessary information to enable those skilled in the art to practice the disclosure and illustrate the best mode of practicing the disclosure. Upon reading the following description in light of the accompanying drawings, those skilled in the art will understand the concepts of the disclosure and will recognize applications of these concepts not particularly addressed herein. It should be understood that these concepts and applications fall within the scope of the disclosure and the accompanying claims.

RF circuitry, which includes a first main RF switching circuit and a second main RF switching circuit, is disclosed according to one embodiment of the present disclosure. The first main RF switching circuit is capable of providing an RF signal path between a first main RF port and a first selected one of a first RF antenna and a second RF antenna. The second main RF switching circuit is capable of providing an RF signal path between a second main RF port and a second selected one of the first RF antenna and the second RF antenna. The first main RF switching circuit includes a first pair of RF switches, a second pair of RF switches, a first shunt RF switch, and a second shunt RF switch. The first pair of RF switches are coupled in series between the first RF antenna and the first main RF port. The second pair of RF switches are coupled in series between the second RF antenna and the first main RF port. The first shunt RF switch is coupled between a connection to both of the first pair of RF switches and a ground. The second shunt RF switch is coupled between a connection to both of the second pair of RF switches and the ground.

Figure 1:
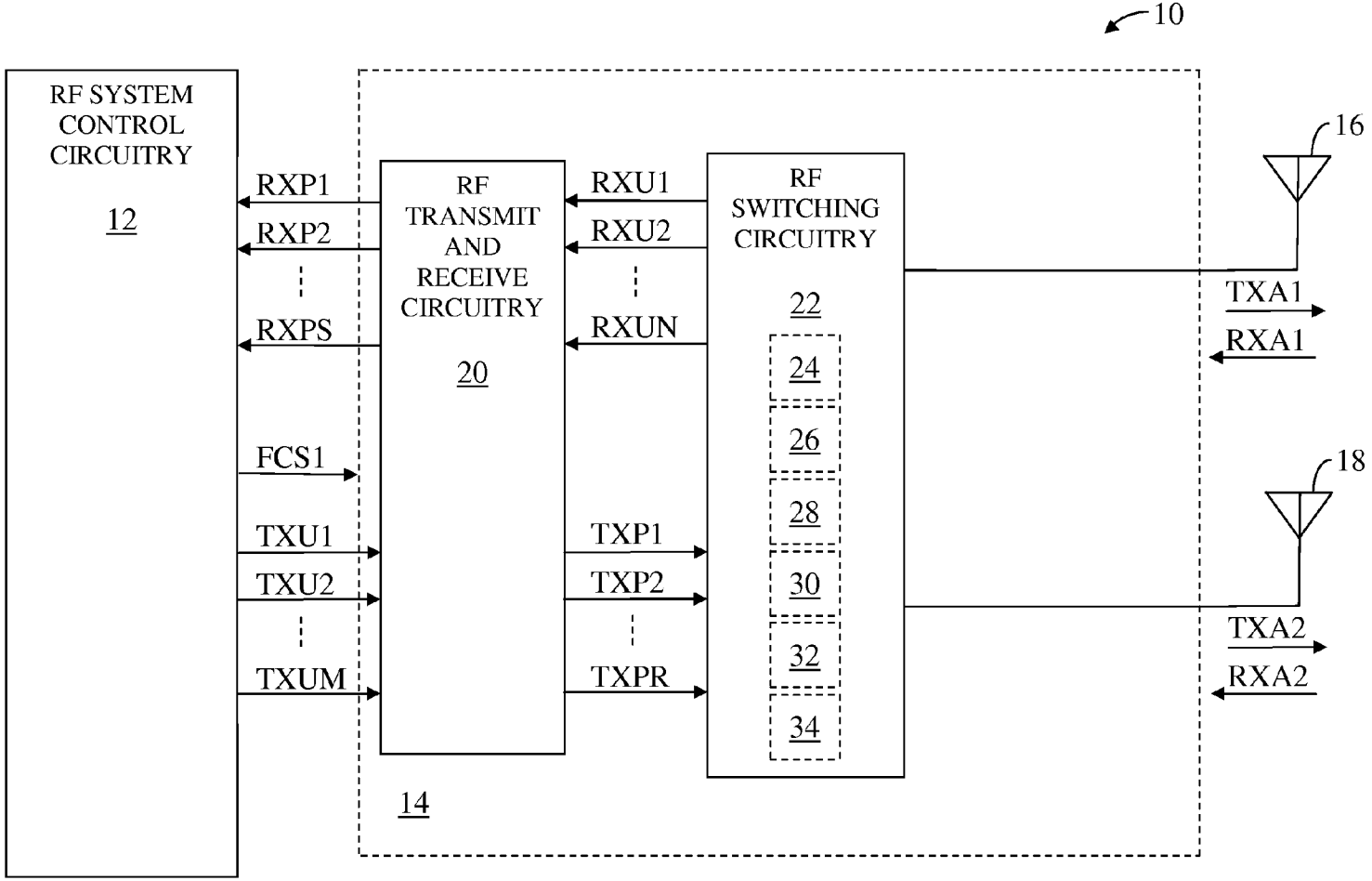
FIG. 1 shows RF communications circuitry according to one embodiment of the RF communications circuitry.

FIG. 1 shows RF communications circuitry 10 according to one embodiment of the RF communications circuitry 10. The RF communications circuitry 10 includes RF system control circuitry 12, RF front-end circuitry 14, a first RF antenna 16, and a second RF antenna 18. The RF front-end circuitry 14 includes RF transmit and receive circuitry 20, and RF switching circuitry 22. The RF switching circuitry 22 includes a first main RF port 24, a second main RF port 26, and up to and including a $P^{TH}$ main RF port 28. The RF switching circuitry 22 further includes a first auxiliary RF port 30, a second auxiliary RF port 32, and up to and including a $Q^{TH}$ auxiliary RF port 34.

In an alternate embodiment of the RF switching circuitry 22, any or all of the auxiliary RF ports 30, 32, 34 are omitted. In an alternate embodiment of the RF switching circuitry 22, any or all of the main RF ports 24, 26, 28 are omitted except for the first main RF port 24 and the second main RF port 26. The RF transmit and receive circuitry 20 is coupled to the RF switching circuitry 22 via any or all of the RF ports 24, 26, 28, 30, 32, 34. The first RF antenna 16 is coupled to the RF transmit and receive circuitry 20 via at least one RF switch (not shown) in the RF switching circuitry 22. The second RF antenna 18 is coupled to the RF transmit and receive circuitry 20 via at least one RF switch (not shown) in the RF switching circuitry 22.

In one embodiment of the RF transmit and receive circuitry 20, the RF transmit and receive circuitry 20 includes up-conversion circuitry, down-conversion circuitry, amplification circuitry, low noise amplification circuitry, power supply circuitry, filtering circuitry, switching circuitry, combining circuitry, splitting circuitry, dividing circuitry, clocking circuitry, RF duplexers. RF diplexers, the like, or any combination thereof to process the upstream RF signals RXU1, RXU2, RXUN, TXU1, TXU2, TXUM.

In an alternate embodiment of the RF front-end circuitry 14, the RF transmit and receive circuitry 20 is omitted, such that the RF system control circuitry 12 is coupled to the RF switching circuitry 22 via any or all of the RF ports 24, 26, 28, 30, 32, 34. In another embodiment of the RF front-end circuitry 14, the RF transmit and receive circuitry 20 is partially bypassed, such that the RF system control circuitry 12 is coupled to the RF switching circuitry 22 via at least one of the RF ports 24, 26, 28, 30, 32, 34, and the RF transmit and receive circuitry 20 is coupled to the RF switching circuitry 22 via at least one of the RF ports 24, 26, 28, 30, 32, 34.

In one embodiment of the RF system control circuitry 12, the RF system control circuitry 12 provides a first function configuration signal FCS1 to the RF front-end circuitry 14. The RF transmit and receive circuitry 20, the RF switching circuitry 22, or both are configured based on the first function configuration signal FCS1

The RF system control circuitry 12 provides a first upstream RF transmit signal TXU1, a second upstream RF transmit signal TXU2, and up to and including an $M^{TH}$ upstream RF transmit signal TXUM to the RF transmit and receive circuitry 20, which processes the upstream RF transmit signals TXU1, TXU2, TXUM to provide a first processed RF transmit signal TXP1, a second processed RF transmit signal TXP2, and up to and including an $R^{TH}$ processed RF transmit signal TXPR to the RF switching circuitry 22 via any or all of the RF ports 24, 26, 28, 30, 32, 34. In one embodiment of the RF transmit and receive circuitry 20, the processing of the upstream RF transmit signals TXU1, TXU2, TXUM is based on the first function configuration signal FCS1.

In one embodiment of the RF switching circuitry 22, the RF switching circuitry 22 is configured to route any of the processed RF transmit signals TXP1, TXP2, TXPR to the first RF antenna 16 based on the first function configuration signal FCS1. In one embodiment of the RF switching circuitry 22, the RF switching circuitry 22 is configured to route a selected one of the processed RF transmit signals TXP1, TXP2, TXPR based on the first function configuration signal FCS1 to provide a first RF antenna transmit signal TXA1 to the first RF antenna 16, which transmits the first RF antenna transmit signal TXA1.

In one embodiment of the RF switching circuitry 22, the RF switching circuitry 22 is configured to route any of the processed RF transmit signals TXP1, TXP2, TXPR to the second RF antenna 18 based on the first function configuration signal FCS1. In one embodiment of the RF switching circuitry 22, the RF switching circuitry 22 is configured to route a selected one of the processed RF transmit signals TXP1, TXP2, TXPR based on the first function configuration signal FCS1 to provide a second RF antenna transmit signal TXA2 to the second RF antenna 18, which transmits the second RF antenna transmit signal TXA2.

In one embodiment of the RF communications circuitry 10, the first RF antenna transmit signal TXA1 is omitted. In one embodiment of the first RF antenna transmit signal TXA1, the first RF antenna transmit signal TXA1 is a primary transmit signal. In one embodiment of the RF communications circuitry 10, the second RF antenna transmit signal TXA2 is omitted. In one embodiment of the second RF antenna transmit signal TXA2, the second RF antenna transmit signal TXA2 is a primary transmit signal.

In an alternate embodiment of the RF system control circuitry 12, any of the upstream RF transmit signals TXU1, TXU2, TXUM are omitted. In an alternate embodiment of the RF transmit and receive circuitry 20, any of the processed RF transmit signals TXP1, TXP2, TXPR are omitted.

The RF transmit and receive circuitry 20 receives a first upstream RF receive signal RXU1, a second upstream RF receive signal RXU2, and up to and including an $N^{TH}$ upstream RF receive signal RXUN from the RF switching circuitry 22 via any or all of the RF ports 24, 26, 28, 30, 32, 34. The RF transmit and receive circuitry 20 processes the upstream RF receive signals RXU1, RXU2, RXUN to provide a first processed RF receive signal RXP1, a second processed RF receive signal RXP2, and up to and including an $S^{TH}$ processed RF receive signal RXPS to the RF system control circuitry 12. In one embodiment of the RF transmit and receive circuitry 20, the processing of the upstream RF receive signals RXU1, RXU2, RXUN is based on the first function configuration signal FCS1.

In an alternate embodiment of the RF switching circuitry 22, any of the upstream RF receive signals RXU1, RXU2, RXUN are omitted. In an alternate embodiment of the RF transmit and receive circuitry 20, any of the processed RF receive signals RXP1, RXP2, RXPS are omitted.

In one embodiment of the first RF antenna 16, the first RF antenna 16 is configured to receive and forward RF signals to the RF switching circuitry 22. In one embodiment of the first RF antenna 16, the first RF antenna 16 is configured to receive and forward a first RF antenna receive signal RXA1 to the RF switching circuitry 22. In one embodiment of the RF switching circuitry 22, the RF switching circuitry 22 is configured to route the first RF antenna receive signal RXA1 to the RF transmit and receive circuitry 20 based on the first function configuration signal FCS1. In one embodiment of the RF switching circuitry 22, the RF switching circuitry 22 is configured to route the first RF antenna receive signal RXA1 to provide a selected one of the upstream RF receive signals RXU1, RXU2, RXUN based on the first function configuration signal FCS1.

In one embodiment of the second RF antenna 18, the second RF antenna 18 is configured to receive and forward RF signals to the RF switching circuitry 22. In one embodiment of the second RF antenna 18, the second RF antenna 18 is configured to receive and forward a second RF antenna receive signal RXA2 to the RF switching circuitry 22. In one embodiment of the RF switching circuitry 22, the RF switching circuitry 22 is configured to route the second RF antenna receive signal RXA2 to the RF transmit and receive circuitry 20 based on the first function configuration signal FCS1. In one embodiment of the RF switching circuitry 22, the RF switching circuitry 22 is configured to route the second RF antenna receive signal RXA2 to provide a selected one of the upstream RF receive signals RXU1, RXU2, RXUN based on the first function configuration signal FCS1.

In one embodiment of the RF communications circuitry 10, the first RF antenna receive signal RXA1 is omitted. In one embodiment of the first RF antenna receive signal RXA1, the first RF antenna receive signal RXA1 is a primary receive signal. In an alternate embodiment of the first RF antenna receive signal RXA1, the first RF antenna receive signal RXA1 is a diversity receive signal. In an additional embodiment of the first RF antenna receive signal RXA1, the first RF antenna receive signal RXA1 is a CA receive signal.

In one embodiment of the RF communications circuitry 10, the second RF antenna receive signal RXA2 is omitted. In one embodiment of the second RF antenna receive signal RXA2, the second RF antenna receive signal RXA2 is a primary receive signal. In an alternate embodiment of the second RF antenna receive signal RXA2, the second RF antenna receive signal RXA2 is a diversity receive signal. In an additional embodiment of the second RF antenna receive signal RXA2, the second RF antenna receive signal RXA2 is a CA receive signal.

In a first embodiment of the antenna signals TXA1, TXA2, RXA1, RXA2, the first RF antenna transmit signal TXA1 and the first RF antenna receive signal RXA1 are full-duplex RF signals; the second RF antenna transmit signal TXA2 is omitted; and the second RF antenna receive signal RXA2 is a receive-only diversity signal.

In a second embodiment of the antenna signals TXA1, TXA2, RXA1, RXA2, the first RF antenna transmit signal TXA1 and the first RF antenna receive signal RXA1 are half-duplex RF signals; the second RF antenna transmit signal TXA2 is omitted; and the second RF antenna receive signal RXA2 is a receive-only diversity signal.

In a third embodiment of the antenna signals TXA1, TXA2, RXA1, RXA2, the second RF antenna transmit signal TXA2 and the second RF antenna receive signal RXA2 are full-duplex RF signals; the first RF antenna transmit signal TXA1 is omitted; and the first RF antenna receive signal RXA1 is a receive-only diversity signal.

In a fourth embodiment of the antenna signals TXA1, TXA2, RXA1, RXA2, the second RF antenna transmit signal TXA2 and the second RF antenna receive signal RXA2 are half-duplex RF signals; the first RF antenna transmit signal TXA1 is omitted; and the first RF antenna receive signal RXA1 is a receive-only diversity signal. In this regard, the RF switching circuitry 22 provides flexibility by allowing the first RF antenna 16 and the second RF antenna 18 to be functionally swapped.

In one embodiment of the antenna signals TXA1, TXA2, RXA1, RXA2, the first RF antenna transmit signal TXA1 and the first RF antenna receive signal RXA1 are primary RF signals; the second RF antenna transmit signal TXA2 is omitted; and the second RF antenna receive signal RXA2 is an additional RF receive signal, such that the first RF antenna receive signal RXA1 and the second RF antenna receive signal RXA2 provide receive carrier aggregation (CA).

In an alternate embodiment of the antenna signals TXA1, TXA2, RXA1, RXA2, the second RF antenna transmit signal TXA2 and the second RF antenna receive signal RXA2 are primary RF signals; the first RF antenna transmit signal TXA1 is omitted; and the first RF antenna receive signal RXA1 is an additional RF receive signal, such that the first RF antenna receive signal RXA1 and the second RF antenna receive signal RXA2 provide receive CA.

In general, the RF switching circuitry 22 may be configured such that any of the RF ports 24, 26, 28, 30, 32, 34 may carry an RF transmit signal only, an RF receive signal only, both RF transmit and RF receive signals, or may be unused. In one embodiment of the RF switching circuitry 22, when one of the RF ports 24, 26, 28, 30, 32, 34 is connected to the first RF antenna 16, another of the RF ports 24, 26, 28, 30, 32, 34 is connected to the second RF antenna 18. In an alternate embodiment of the RF switching circuitry 22, when one of the RF ports 24, 26, 28, 30, 32, 34 is connected to the first RF antenna 16, none of the RF ports 24, 26, 28, 30, 32, 34 is connected to the second RF antenna 18. In an additional embodiment of the RF switching circuitry 22, when one of the RF ports 24, 26, 28, 30, 32, 34 is connected to the second RF antenna 18, none of the RF ports 24, 26, 28, 30, 32, 34 is connected to the first RF antenna 16.

In one embodiment of the RF switching circuitry 22, the RF switching circuitry 22 provides flexible switching between the RF ports 24, 26, 28, 30, 32, 34 and the RF antennas 16, 18, high isolation between the first RF antenna 16 and the second RF antenna 18, a small form factor, or any combination thereof.

Figure 2:
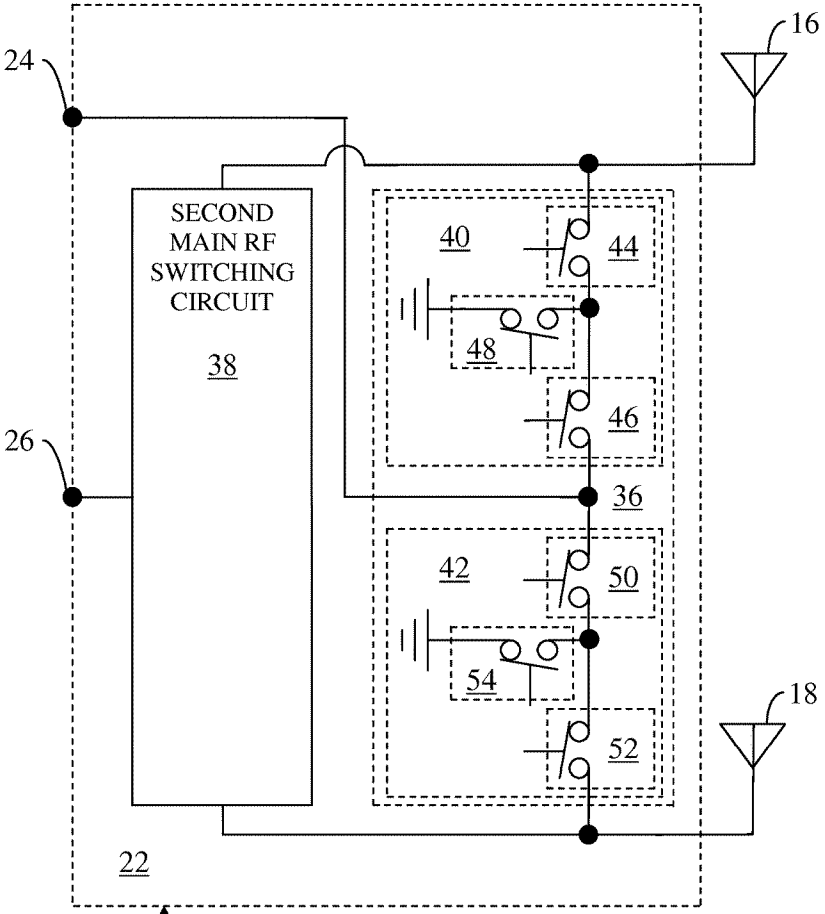
FIG. 2 shows details of RF switching circuitry illustrated in FIG. 1 according to one embodiment of the RF switching circuitry.

FIG. 2 shows details of RF switching circuitry 22 illustrated in FIG. 1 according to one embodiment of the RF switching circuitry 22. The RF switching circuitry 22 illustrated in FIG. 2 omits the $P^{TH}$ main RF port 28, the first auxiliary RF port 30, the second auxiliary RF port 32, and the $Q^{TH}$ auxiliary RF port 34. Additionally, the first RF antenna 16 and the second RF antenna 18 are shown in FIG. 2 for clarity. Also, the RF switching circuitry 22 receives the first function configuration signal FCS1.

The RF switching circuitry 22 includes the first main RF port 24, the second main RF port 26, a first main RF switching circuit 36, and a second main RF switching circuit 38. The first series-shunt-series switching circuit 40 includes a first series RF switch 44, a second series RF switch 46, and a first shunt RF switch 48. The second series-shunt-series switching circuit 42 includes a third series RF switch 50, a fourth series RF switch 52, and a second shunt RF switch 54.

The first series RF switch 44 and the second series RF switch 46 are coupled in series between the first RF antenna 16 and the first main RF port 24. In general, the first series RF switch 44 and the second series RF switch 46 form a first pair of RF switches coupled in series between the first RF antenna 16 and the first main RF port 24. The first shunt RF switch 48 is coupled between a ground and a connection between the first series RF switch 44 and the second series RF switch 46. In general, the first shunt RF switch 48 is coupled between a connection to both of the first pair of RF switches and the ground.

The third series RF switch 50 and the fourth series RF switch 52 are coupled in series between the second RF antenna 18 and the first main RF port 24. In general, the third series RF switch 50 and the fourth series RF switch 52 form a second pair of RF switches coupled in series between the second RF antenna 18 and the first main RF port 24. The second shunt RF switch 54 is coupled between the ground and a connection between the third series RF switch 50 and the fourth series RF switch 52. In general, the second shunt RF switch 54 is coupled between a connection to both of the second pair of RF switches and the ground.

The first main RF switching circuit 36 is capable of providing an RF signal path between the first main RF port 24 and a first selected one of the first RF antenna 16 and the second RF antenna 18. The first main RF switching circuit 36 is capable of approximately providing isolation between the first main RF port 24 and a first selected another of the first RF antenna 16 and the second RF antenna 18. For example, if the first selected one of the first RF antenna 16 and the second RF antenna 18 is the first RF antenna 16, then the first selected another of the first RF antenna 16 and the second RF antenna 18 is the second RF antenna 18. Conversely, if the first selected one of the first RF antenna 16 and the second RF antenna 18 is the second RF antenna 18, then the first selected another of the first RF antenna 16 and the second RF antenna 18 is the first RF antenna 16.

The second main RF switching circuit 38 is capable of providing an RF signal path between the second main RF port 26 and a second selected one of the first RF antenna 16 and the second RF antenna 18. The second main RF switching circuit 38 is capable of approximately providing isolation between the second main RF port 26 and a second selected another of the first RF antenna 16 and the second RF antenna 18. For example, if the second selected one of the first RF antenna 16 and the second RF antenna 18 is the first RF antenna 16, then the second selected another of the first RF antenna 16 and the second RF antenna 18 is the second RF antenna 18. Conversely, if the second selected one of the first RF antenna 16 and the second RF antenna 18 is the second RF antenna 18, then the second selected another of the first RF antenna 16 and the second RF antenna 18 is the first RF antenna 16.

In one embodiment of the RF switching circuitry 22, the second main RF switching circuit 38, the first series RF switch 44, the second series RF switch 46, the first shunt RF switch 48, the third series RF switch 50, the fourth series RF switch 52, and the second shunt RF switch 54 are configured based on the first function configuration signal FCS1.

When the first selected one of the first RF antenna 16 and the second RF antenna 18 is the first RF antenna 16 and the first selected another of the first RF antenna 16 and the second RF antenna 18 is the second RF antenna 18, as previously mentioned, the first series RF switch 44, the second series RF switch 46, and the second shunt RF switch 54 are CLOSED, and the first shunt RF switch 48, the third series RF switch 50, and the fourth series RF switch 52 are OPEN.

The combination of the third series RF switch 50 and the fourth series RF switch 52 being OPEN and the second shunt RF switch 54 being CLOSED provides good isolation between the first main RF port 24 and the second RF antenna 18. In this regard, any undesired signals that may be coupled through the third series RF switch 50 and the fourth series RF switch 52 may be shunted to ground through the second shunt RF switch 54. However, since both the first series RF switch 44 and the second series RF switch 46 must be CLOSED to provide the RF signal path between the first main RF port 24 and the first RF antenna 16, an insertion loss in the RF signal path includes insertion loss of two series RF switches, namely the first series RF switch 44 and the second series RF switch 46. As a result, when compared with single series RF switch designs, the insertion loss of the first series RF switch 44 and the second series RF switch 46 may have to be reduced by up to a factor of two, which may increase widths of the first series RF switch 44 and the second series RF switch 46 by up to a factor of two, thereby increasing size and cost. So, the improved isolation may have tradeoffs.

Conversely, when the first selected one of the first RF antenna 16 and the second RF antenna 18 is the second RF antenna 18 and the first selected another of the first RF antenna 16 and the second RF antenna 18 is the first RF antenna 16, as previously mentioned, the first series RF switch 44, the second series RF switch 46, and the second shunt RF switch 54 are OPEN, and the first shunt RF switch 48, the third series RF switch 50, and the fourth series RF switch 52 are CLOSED. The improved isolation tradeoffs mentioned above may also apply.

Figure 3:
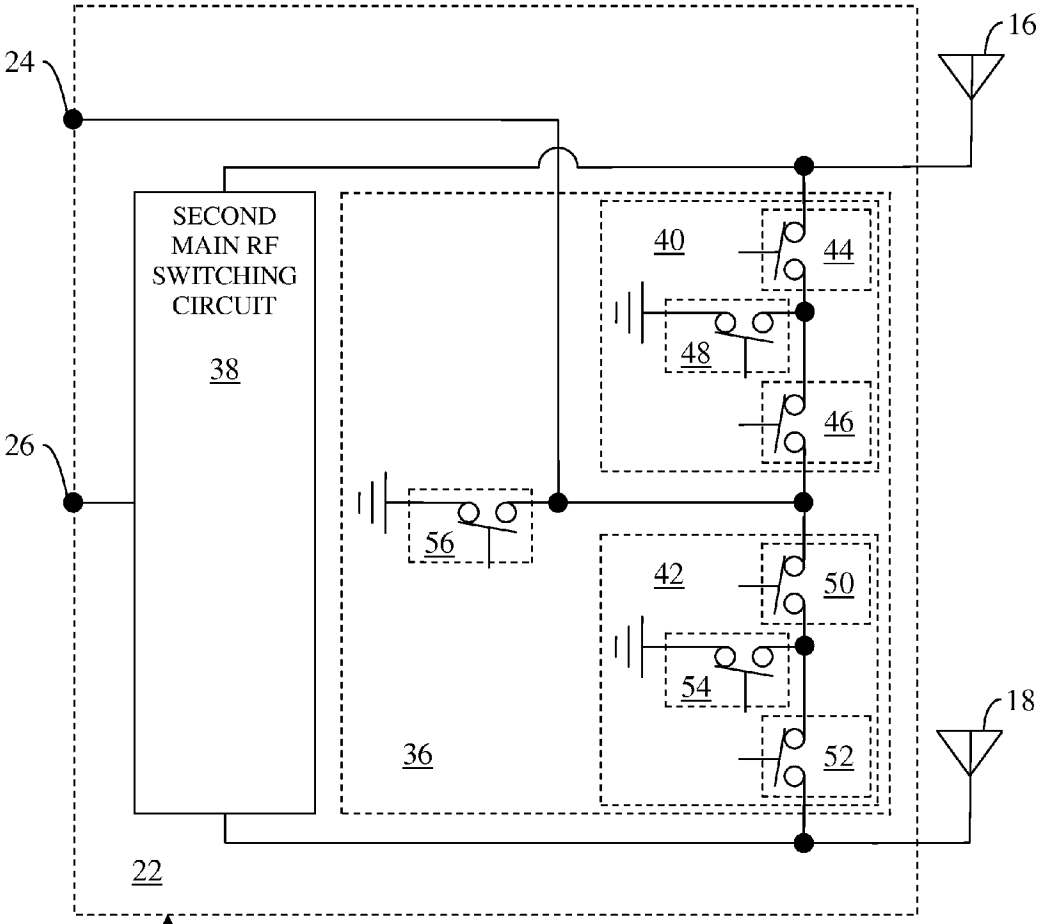
FIG. 3 shows details of the RF switching circuitry illustrated in FIG. 1 according to an alternate embodiment of the RF switching circuitry.

FIG. 3 shows details of the RF switching circuitry 22 illustrated in FIG. 1 according to an alternate embodiment of the RF switching circuitry 22. The RF switching circuitry 22 illustrated in FIG. 3 is similar to the RF switching circuitry 22 illustrated in FIG. 2, except in the RF switching circuitry 22 illustrated in FIG. 3, the first main RF switching circuit 36 further includes a third shunt RF switch 56 coupled between the first main RF port 24 and the ground. The RF switching circuitry 22 illustrated in FIG. 3 is configured based on the first function configuration signal FCS1.

In this regard, when the first main RF switching circuit 36 is configured to provide isolation between the first main RF port 24 and both of the first RF antenna 16 and the second RF antenna 18; all of the first series RF switch 44, the second series RF switch 46, the third series RF switch 50, and the fourth series RF switch 52 are OPEN; and all of the first shunt RF switch 48, second shunt RF switch 54, and third shunt RF switch 56 are CLOSED. The third shunt RF switch 56 provides an additional shunt path to ground, which may further improve isolation.

Figure 4:
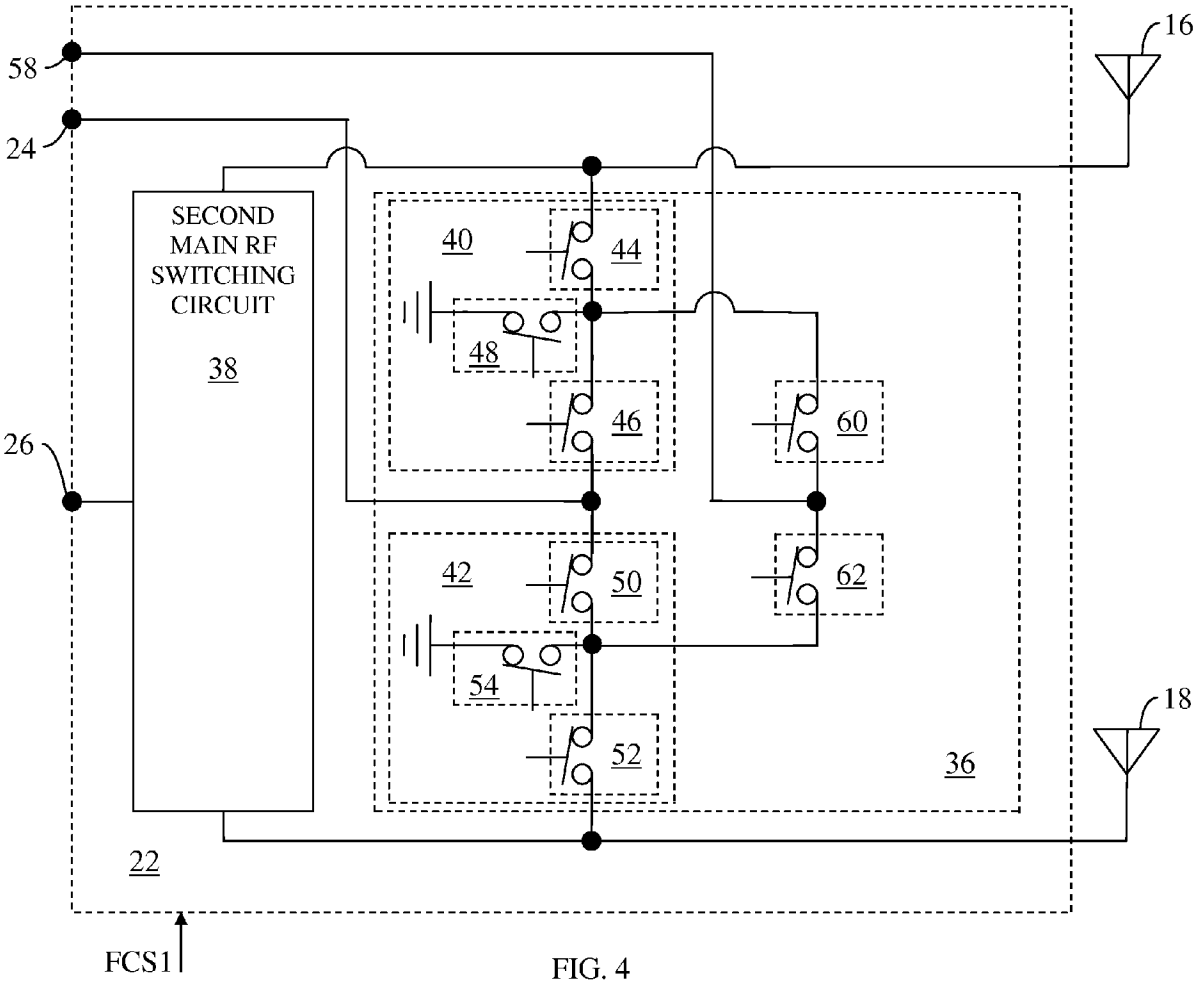
FIG. 4 shows details of the RF switching circuitry illustrated in FIG. 1 according to an additional embodiment of the RF switching circuitry.

FIG. 4 shows details of the RF switching circuitry 22 illustrated in FIG. 1 according to an additional embodiment of the RF switching circuitry 22. The RF switching circuitry 22 illustrated in FIG. 4 is similar to the RF switching circuitry 22 illustrated in FIG. 2, except in the RF switching circuitry 22 illustrated in FIG. 4, the RF switching circuitry 22 further has a third main RF port 58 and the first main RF switching circuit 36 further includes a first inner series RF switch 60 and a second inner series RF switch 62. The RF switching circuitry 22 illustrated in FIG. 4 is configured based on the first function configuration signal FCS1.

The first inner series RF switch 60 is coupled between the third main RF port 58 and a connection between the first series RF switch 44, the second series RF switch 46, and the first shunt RF switch 48. The second inner series RF switch 62 is coupled between the third main RF port 58 and a connection between the third series RF switch 50, the fourth series RF switch 52, and the second shunt RF switch 54.

In this regard, a signal path between the first RF antenna 16 and the first main RF port 24, and a signal path between the first RF antenna 16 and the third main RF port 58 both share the first series RF switch 44. Similarly, a signal path between the second RF antenna 18 and the first main RF port 24, and a signal path between the second RF antenna 18 and the third main RF port 58 both share the fourth series RF switch 52. Sharing the first series RF switch 44 and the fourth series RF switch 52 may reduce cost, space, or both. However, isolation between the first main RF port 24 and the third main RF port 58 may be reduced.

Figure 5:
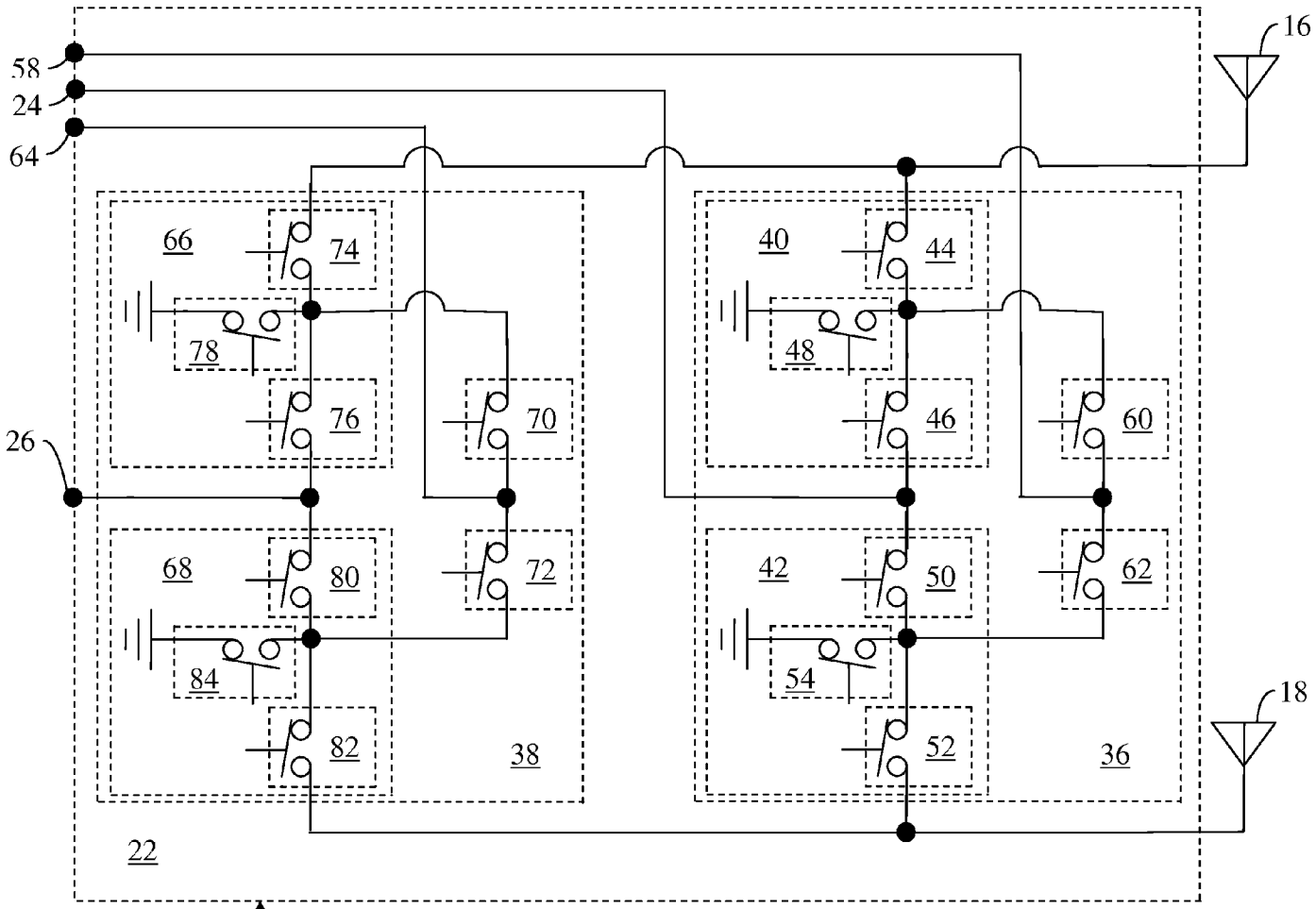
FIG. 5 shows details of the RF switching circuitry illustrated in FIG. 1 according to another embodiment of the RF switching circuitry.

FIG. 5 shows details of the RF switching circuitry 22 illustrated in FIG. 1 according to another embodiment of the RF switching circuitry 22. The RF switching circuitry 22 illustrated in FIG. 5 is similar to the RF switching circuitry 22 illustrated in FIG. 4, except in the RF switching circuitry 22 illustrated in FIG. 5, the RF switching circuitry 22 further includes a fourth main RF port 64 and the second main RF switching circuit 38 includes a third series-shunt-series switching circuit 66, a fourth series-shunt-series switching circuit 68, a third inner series RF switch 70, and a fourth inner series RF switch 72. The second main RF switching circuit 38 is similar to the first main RF switching circuit 36. As such, the second main RF switching circuit 38 may perform in a similar manner to the first main RF switching circuit 36 with similar benefits and similar limitations. The RF switching circuitry 22 illustrated in FIG. 5 is configured based on the first function configuration signal FCS1.

The third series-shunt-series switching circuit 66 includes a fifth series RF switch 74, a sixth series RF switch 76, and a fourth shunt RF switch 78. The fourth series-shunt-series switching circuit 68 includes a seventh series RF switch 80, an eighth series RF switch 82, and a fifth shunt RF switch 84. The fifth series RF switch 74 and the sixth series RF switch 76 are coupled in series between the first RF antenna 16 and the second main RF port 26. In general, the fifth series RF switch 74 and the sixth series RF switch 76 form a third pair of RF switches coupled in series between the first RF antenna 16 and the second main RF port 26. The fourth shunt RF switch 78 is coupled between the ground and a connection between the fifth series RF switch 74, the sixth series RF switch 76, and the third inner series RF switch 70. In general, the fourth shunt RF switch 78 is coupled between the ground and a connection to all of the third inner series RF switch 70 and the third pair of RF switches.

The seventh series RF switch 80 and the eighth series RF switch 82 are coupled in series between the second RF antenna 18 and the second main RF port 26. In general, the seventh series RF switch 80 and the eighth series RF switch 82 form a fourth pair of RF switches coupled in series between the second RF antenna 18 and the second main RF port 26. The fifth shunt RF switch 84 is coupled between the ground and a connection between the seventh series RF switch 80, the eighth series RF switch 82, and the fourth inner series RF switch 72. In general, the fifth shunt RF switch 84 is coupled between the ground and a connection to all of the fourth inner series RF switch 72 and the fourth pair of RF switches. In an alternate embodiment of the RF switching circuitry 22, the third inner series RF switch 70, the fourth inner series RF switch 72, or both are omitted.

Figure 6:
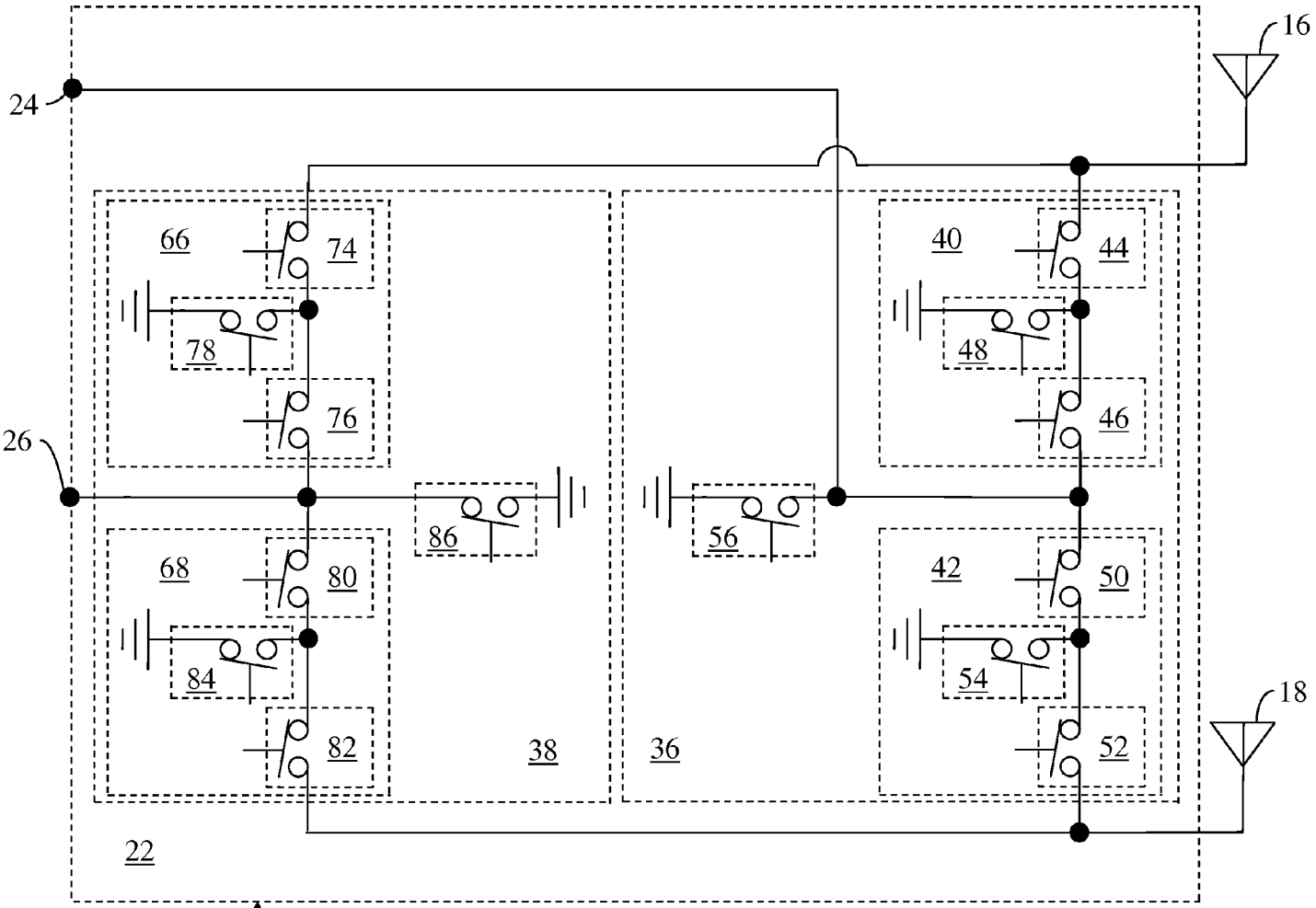
FIG. 6 shows details of the RF switching circuitry illustrated in FIG. 1 according to a further embodiment of the RF switching circuitry.

FIG. 6 shows details of the RF switching circuitry 22 illustrated in FIG. 1 according to a further embodiment of the RF switching circuitry 22. The RF switching circuitry 22 illustrated in FIG. 6 is similar to the RF switching circuitry 22 illustrated in FIG. 5, except in the RF switching circuitry 22 illustrated in FIG. 6, the first main RF switching circuit 36 further includes the third shunt RF switch 56 and the second main RF switching circuit 38 further includes a sixth shunt RF switch 86 and omits the third inner series RF switch 70 and the fourth inner series RF switch 72. The RF switching circuitry 22 illustrated in FIG. 6 is configured based on the first function configuration signal FCS1.

The third shunt RF switch 56 is coupled between the first main RF port 24 and the ground as shown in FIG. 3. Similarly, the sixth shunt RF switch 86 is coupled between the second main RF port 26 and the ground. In this regard, when the second main RF switching circuit 38 is configured to provide isolation between the second main RF port 26 and both of the first RF antenna 16 and the second RF antenna 18, and all of the fifth series RF switch 74, the sixth series RF switch 76, the seventh series RF switch 80, and the eighth series RF switch 82 are OPEN; and all of the fourth shunt RF switch 78, the fifth shunt RF switch 84, and the sixth shunt RF switch 86 are CLOSED. The sixth shunt RF switch 86 provides an additional shunt path to ground, which may further improve isolation.

Figure 7:
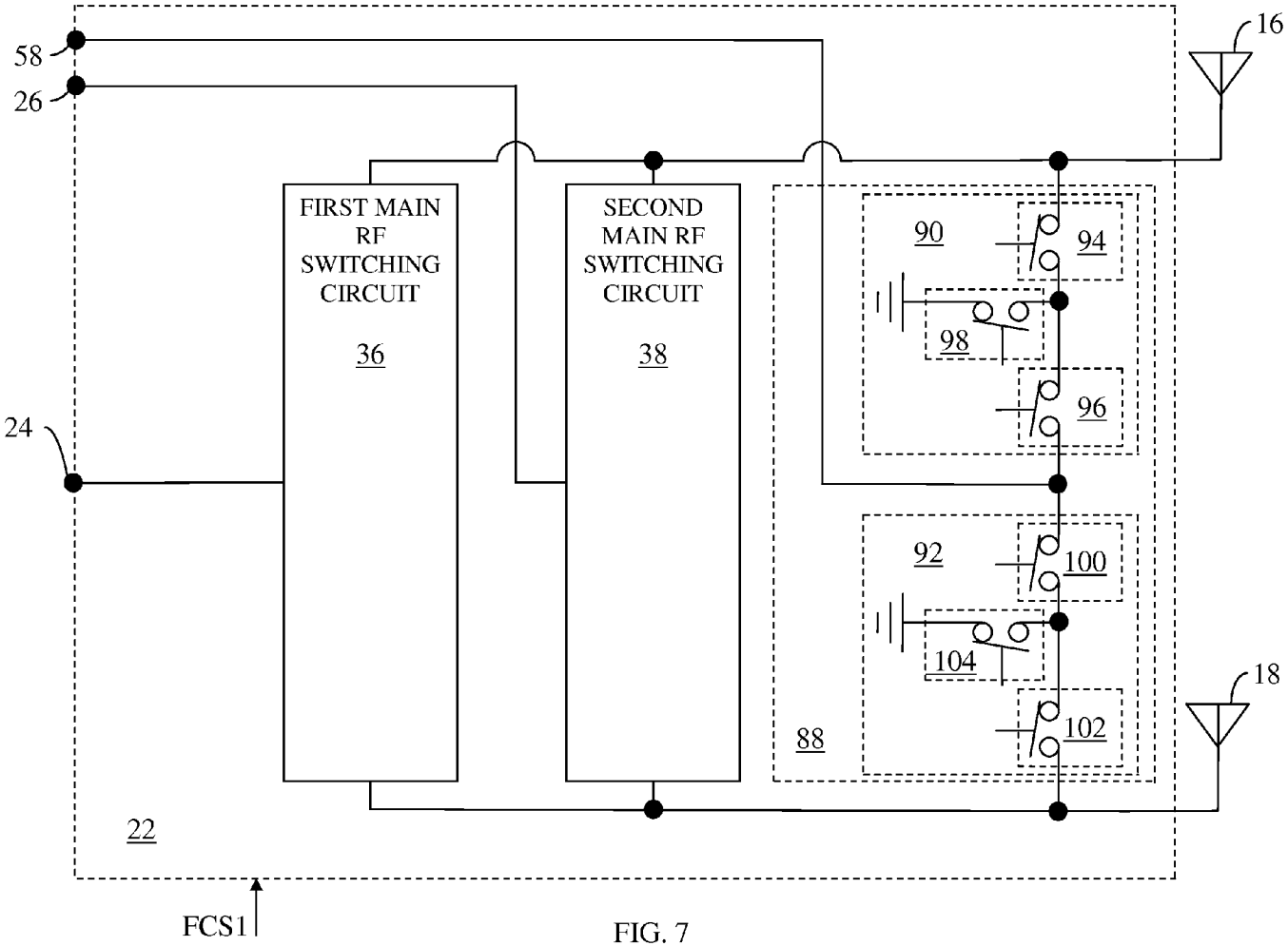
FIG. 7 shows details of the RF switching circuitry illustrated in FIG. 1 according to one embodiment of the RF switching circuitry.

FIG. 7 shows details of the RF switching circuitry 22 illustrated in FIG. 1 according to one embodiment of the RF switching circuitry 22. The RF switching circuitry 22 illustrated in FIG. 7 is similar to the RF switching circuitry 22 illustrated in FIG. 2, except the RF switching circuitry 22 illustrated in FIG. 7 further includes a third main RF switching circuit 88 and the third main RF port 58. The third main RF switching circuit 88 is coupled between the first RF antenna 16 and the second RF antenna 18, and is coupled to the third main RF port 58. The RF switching circuitry 22 illustrated in FIG. 7 is configured based on the first function configuration signal FCS1.

The third main RF switching circuit 88 includes a fifth series-shunt-series switching circuit 90 and a sixth series-shunt-series switching circuit 92. The fifth series-shunt-series switching circuit 90 is coupled between the first RF antenna 16 and the third main RF port 58. The sixth series-shunt-series switching circuit 92 is coupled between the second RF antenna 18 and the third main RF port 58. The fifth series-shunt-series switching circuit 90 includes a ninth series RF switch 94, a tenth series RF switch 96, and a seventh shunt RF switch 98. The sixth series-shunt-series switching circuit 92 includes an eleventh series RF switch 100, a twelfth series RF switch 102, and an eighth shunt RF switch 104.

The ninth series RF switch 94 and the tenth series RF switch 96 are coupled in series between the first RF antenna 16 and the third main RF port 58. In general, the ninth series RF switch 94 and the tenth series RF switch 96 form a fifth pair of RF switches coupled in series between the first RF antenna 16 and the third main RF port 58. The seventh shunt RF switch 98 is coupled between a ground and a connection between the ninth series RF switch 94 and the tenth series RF switch 96. In general, the seventh shunt RF switch 98 is coupled between a connection to both of the fifth pair of RF switches and the ground.

The eleventh series RF switch 100 and the twelfth series RF switch 102 are coupled in series between the second RF antenna 18 and the third main RF port 58. In general, the eleventh series RF switch 100 and the twelfth series RF switch 102 form a sixth pair of RF switches coupled in series between the second RF antenna 18 and the third main RF port 58. The eighth shunt RF switch 104 is coupled between the ground and a connection between the eleventh series RF switch 100 and the twelfth series RF switch 102. In general, the eighth shunt RF switch 104 is coupled between a connection to both of the sixth pair of RF switches and the ground.

Figure 8:
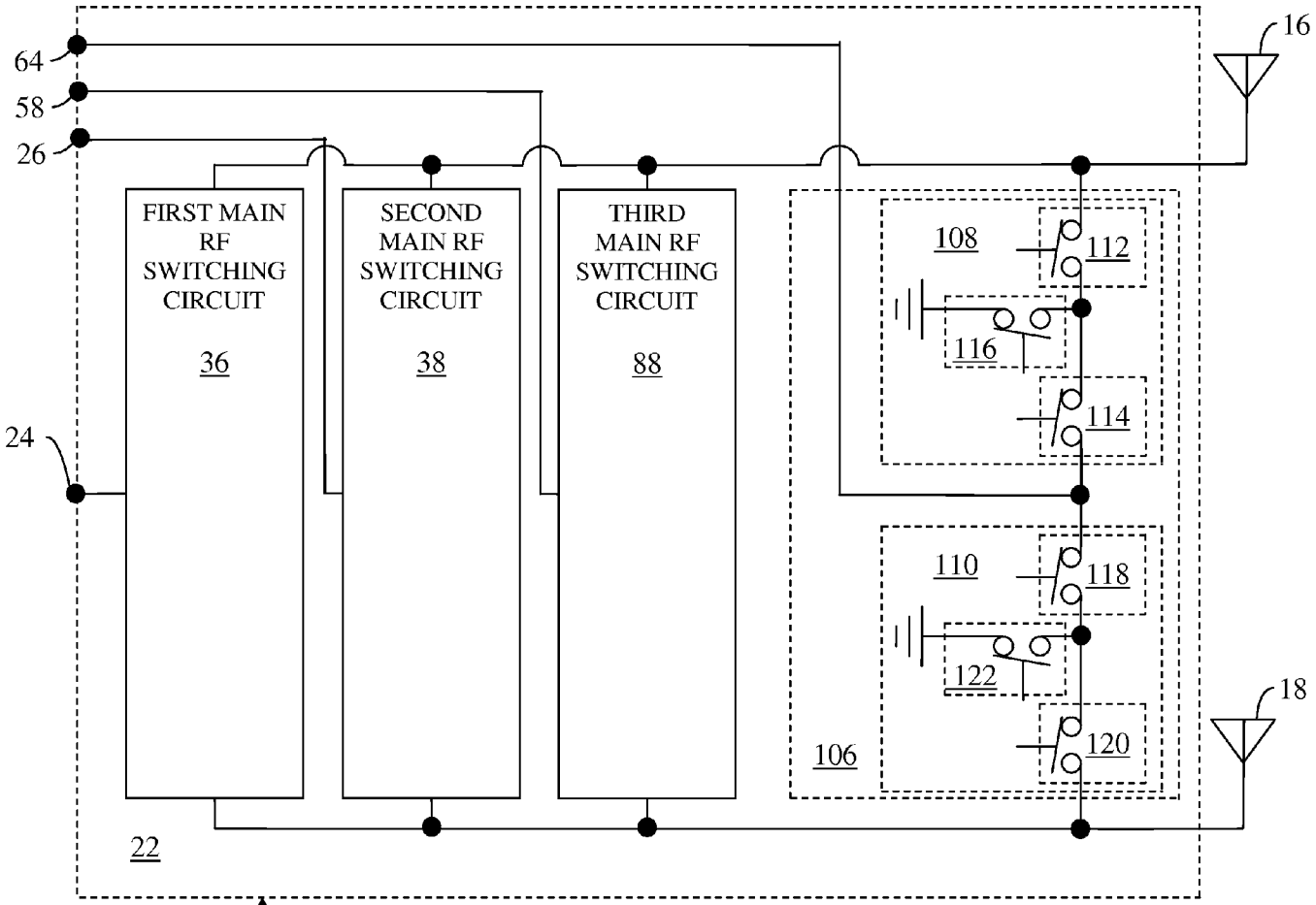
FIG. 8 shows details of the RF switching circuitry illustrated in FIG. 1 according to an alternate embodiment of the RF switching circuitry.

FIG. 8 shows details of the RF switching circuitry 22 illustrated in FIG. 1 according to an alternate embodiment of the RF switching circuitry 22. The RF switching circuitry 22 illustrated in FIG. 8 is similar to the RF switching circuitry 22 illustrated in FIG. 7, except the RF switching circuitry 22 illustrated in FIG. 8 further includes a fourth main RF switching circuit 106 and the fourth main RF port 64. The fourth main RF switching circuit 106 is coupled between the first RF antenna 16 and the second RF antenna 18, and is coupled to the fourth main RF port 64. The RF switching circuitry 22 illustrated in FIG. 8 is configured based on the first function configuration signal FCS1.

The fourth main RF switching circuit 106 includes a seventh series-shunt-series switching circuit 108 and an eighth series-shunt-series switching circuit 110. The seventh series-shunt-series switching circuit 108 is coupled between the first RF antenna 16 and the fourth main RF port 64. The eighth series-shunt-series switching circuit 110 is coupled between the second RF antenna 18 and the fourth main RF port 64. The seventh series-shunt-series switching circuit 108 includes a thirteenth series RF switch 112, a fourteenth series RF switch 114, and a ninth shunt RF switch 116. The eighth series-shunt-series switching circuit 110 includes a fifteenth series RF switch 118, a sixteenth series RF switch 120, and a tenth shunt RF switch 122.

The thirteenth series RF switch 112 and the fourteenth series RF switch 114 are coupled in series between the first RF antenna 16 and the fourth main RF port 64. In general, the thirteenth series RF switch 112 and the fourteenth series RF switch 114 form a seventh pair of RF switches coupled in series between the first RF antenna 16 and the fourth main RF port 64. The ninth shunt RF switch 116 is coupled between the ground and a connection between the thirteenth series RF switch 112 and the fourteenth series RF switch 114. In general, the ninth shunt RF switch 116 is coupled between a connection to both of the seventh pair of RF switches and the ground.

The fifteenth series RF switch 118 and the sixteenth series RF switch 120 are coupled in series between the second RF antenna 18 and the fourth main RF port 64. In general, the fifteenth series RF switch 118 and the sixteenth series RF switch 120 form an eighth pair of RF switches coupled in series between the second RF antenna 18 and the fourth main RF port 64. The tenth shunt RF switch 122 is coupled between the ground and a connection between the fifteenth series RF switch 118 and the sixteenth series RF switch 120. In general, the tenth shunt RF switch 122 is coupled between a connection to both of the eighth pair of RF switches and the ground.

Figure 9:
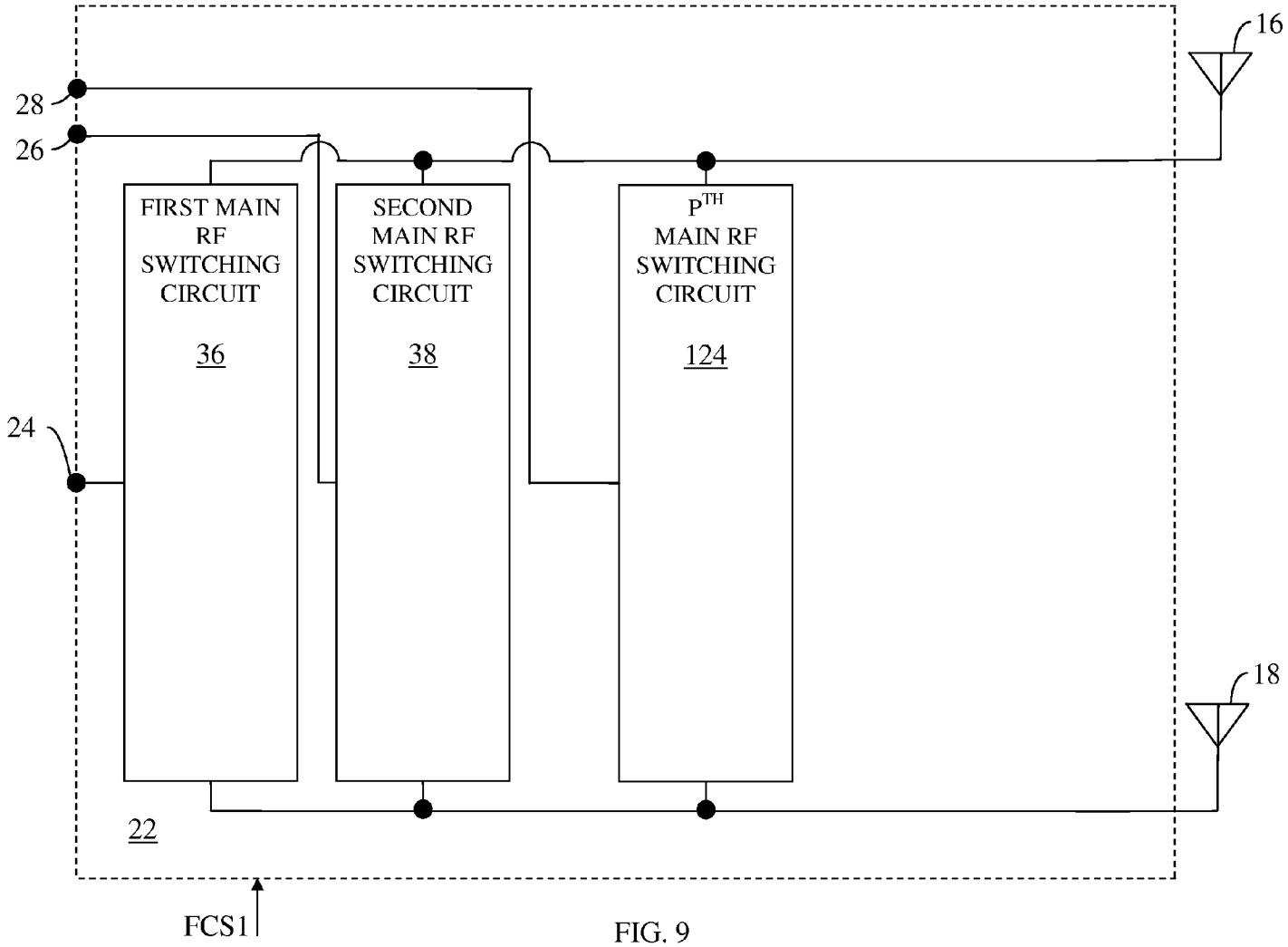
FIG. 9 shows details of the RF switching circuitry illustrated in FIG. 1 according to an additional embodiment of the RF switching circuitry.

FIG. 9 shows details of the RF switching circuitry 22 illustrated in FIG. 1 according to an additional embodiment of the RF switching circuitry 22. The RF switching circuitry 22 illustrated in FIG. 9 is similar to the RF switching circuitry 22 illustrated in FIG. 2, except in the RF switching circuitry 22 illustrated in FIG. 9, in addition to the first main RF switching circuit 36 and the second main RF switching circuit 38, the RF switching circuitry 22 further includes up to and including a $P^{TH}$ main RF switching circuit 124. Further, as illustrated in FIG. 1, the RF switching circuitry 22 includes the first main RF port 24, the second main RF port 26, and up to and including the $P^{TH}$ main RF port 28. The RF switching circuitry 22 illustrated in FIG. 9 is configured based on the first function configuration signal FCS1.

The first main RF switching circuit 36 is coupled between the first RF antenna 16 and the second RF antenna 18, and is coupled to the first main RF port 24. The second main RF switching circuit 38 is coupled between the first RF antenna 16 and the second RF antenna 18, and is coupled to the second main RF port 26. The $P^{TH}$ main RF switching circuit 124 is coupled between the first RF antenna 16 and the second RF antenna 18, and is coupled to the $P^{TH}$ main RF port 28.

Figure 10:
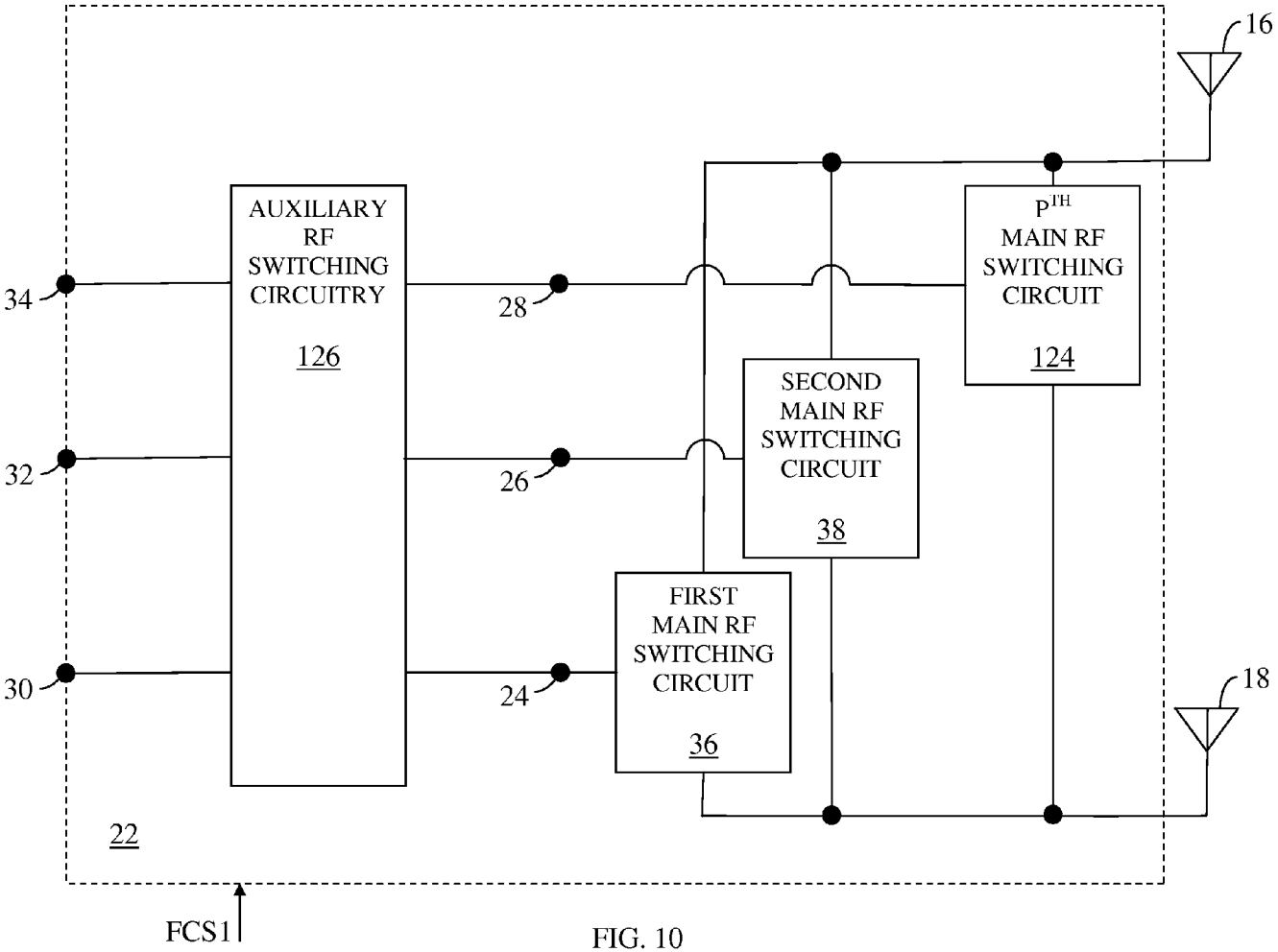
FIG. 10 shows details of the RF switching circuitry illustrated in FIG. 1 according to another embodiment of the RF switching circuitry.

FIG. 10 shows details of the RF switching circuitry 22 illustrated in FIG. 1 according to another embodiment of the RF switching circuitry 22. The RF switching circuitry 22 illustrated in FIG. 10 is similar to the RF switching circuitry 22 illustrated in FIG. 9, except in the RF switching circuitry 22 illustrated in FIG. 10, in addition to the main RF switching circuits 36, 38, 124, the RF switching circuitry 22 further includes auxiliary RF switching circuitry 126. The RF switching circuitry 22 illustrated in FIG. 10 is configured based on the first function configuration signal FCS1.

Further, as illustrated in FIG. 1, the RF switching circuitry 22 includes the auxiliary RF ports 30, 32, 34. The auxiliary RF switching circuitry 126 is coupled between the main RF ports 24, 26, 28 and the auxiliary RF ports 30, 32, 34. In this regard, the auxiliary RF switching circuitry 126 may be used to expand the input/output capacity of the RF switching circuitry 22. In one embodiment of the RF switching circuitry 22, the main RF switching circuits 36, 38, 124 provide very good isolation between the first RF antenna 16 and the second RF antenna 18 and the auxiliary RF switching circuitry 126 provides many ports of access. Since the value of P in the $P^{TH}$ main RF port 28 identifies the number of main RF ports 24, 26, 28 and since the value of Q in the $Q^{TH}$ auxiliary RF port 34 identifies the number of auxiliary RF ports 30, 32, 34, if Q is larger than P, then the auxiliary RF switching circuitry 126 provides more ports of access than do the main RF switching circuits 36, 38, 124 without the auxiliary RF switching circuitry 126.

In an alternate embodiment of the RF switching circuitry 22, a portion of the main RF ports 24, 26, 28 may bypass the auxiliary RF switching circuitry 126 to provide direct access to the main RF switching circuits 36, 38, 124.

Figure 11:
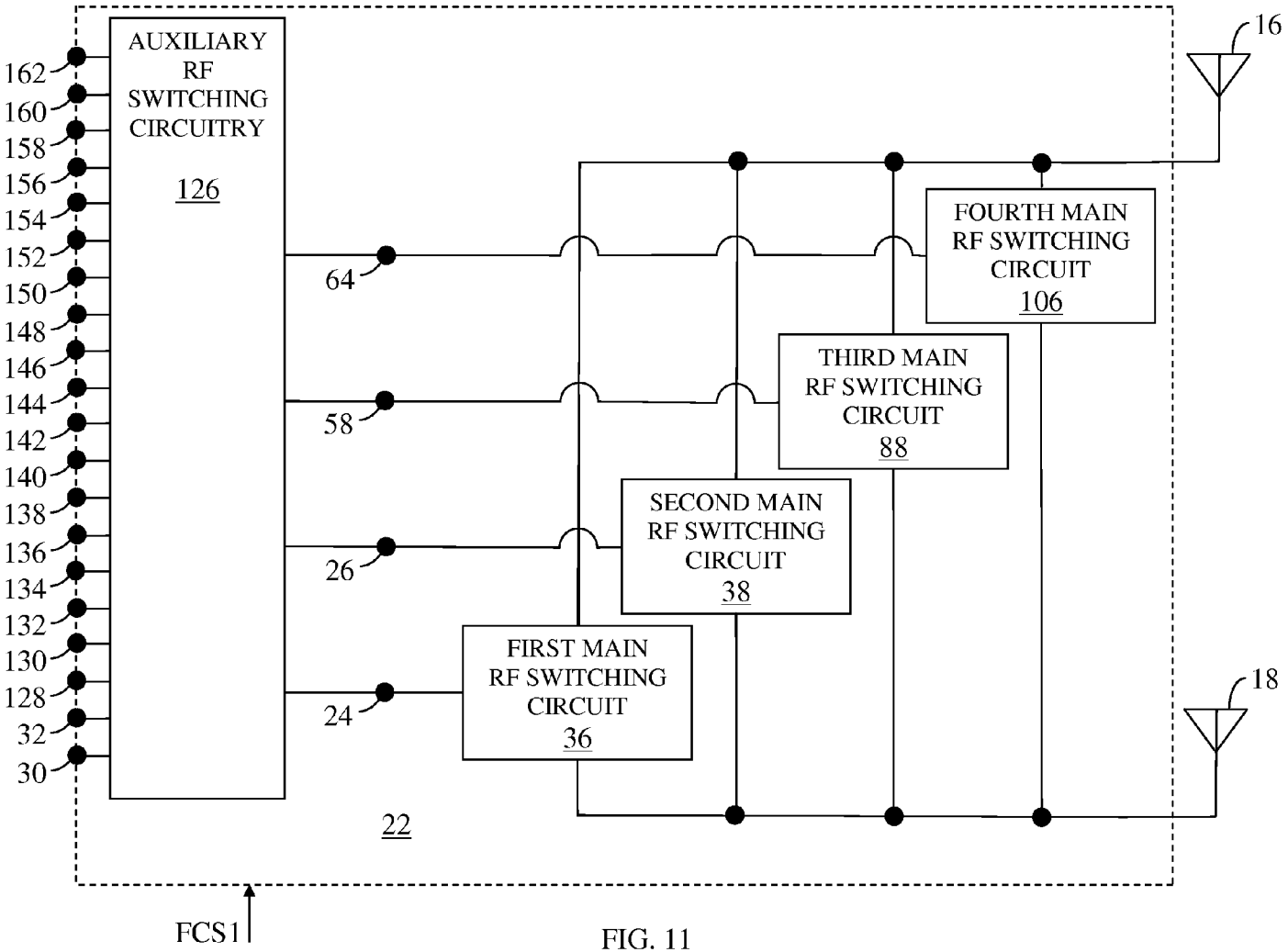
FIG. 11 shows details of the RF switching circuitry illustrated in FIG. 1 according to a further embodiment of the RF switching circuitry.

FIG. 11 shows details of the RF switching circuitry 22 illustrated in FIG. 1 according to a further embodiment of the RF switching circuitry 22. The RF switching circuitry 22 illustrated in FIG. 11 is similar to the RF switching circuitry 22 illustrated in FIG. 8, except the RF switching circuitry 22 illustrated in FIG. 11 further includes the auxiliary RF switching circuitry 126, the first auxiliary RF port 30, the second auxiliary RF port 32, a third auxiliary RF port 128, a fourth auxiliary RF port 130, a fifth auxiliary RF port 132, a sixth auxiliary RF port 134, a seventh auxiliary RF port 136, an eighth auxiliary RF port 138, a ninth auxiliary RF port 140, a tenth auxiliary RF port 142, an eleventh auxiliary RF port 144, a twelfth auxiliary RF port 146, a thirteenth auxiliary RF port 148, a fourteenth auxiliary RF port 150, a fifteenth auxiliary RF port 152, a sixteenth auxiliary RF port 154, a seventeenth auxiliary RF port 156, an eighteenth auxiliary RF port 158, a nineteenth auxiliary RF port 160, and a twentieth auxiliary RF port 162. The RF switching circuitry 22 illustrated in FIG. 11 is configured based on the first function configuration signal FCS1.

In an alternate embodiment of the RF switching circuitry 22, any of the auxiliary RF ports 30, 32, 128, 130, 132, 134, 136, 138, 140, 142, 144, 146, 148, 150, 152, 154, 156, 158, 160, 162 may be omitted. Since the first main RF switching circuit 36, the second main RF switching circuit 38, the third main RF switching circuit 88, and the fourth main RF switching circuit 106 illustrated in FIGS. 2, 5, 7, and 8, respectively, incorporate series-shunt-series architecture between the first RF antenna 16 and the second RF antenna 18, a high level of isolation between the first RF antenna 16 and the second RF antenna 18 may be maintained. However, incorporating the auxiliary RF switching circuitry 126 significantly increases connectivity without significant degradation of isolation between the first RF antenna 16 and the second RF antenna 18. Further, the RF switching circuitry 22 illustrated in FIG. 11 is an example of RF switching circuitry having two poles and twenty throws.

Figure 12:
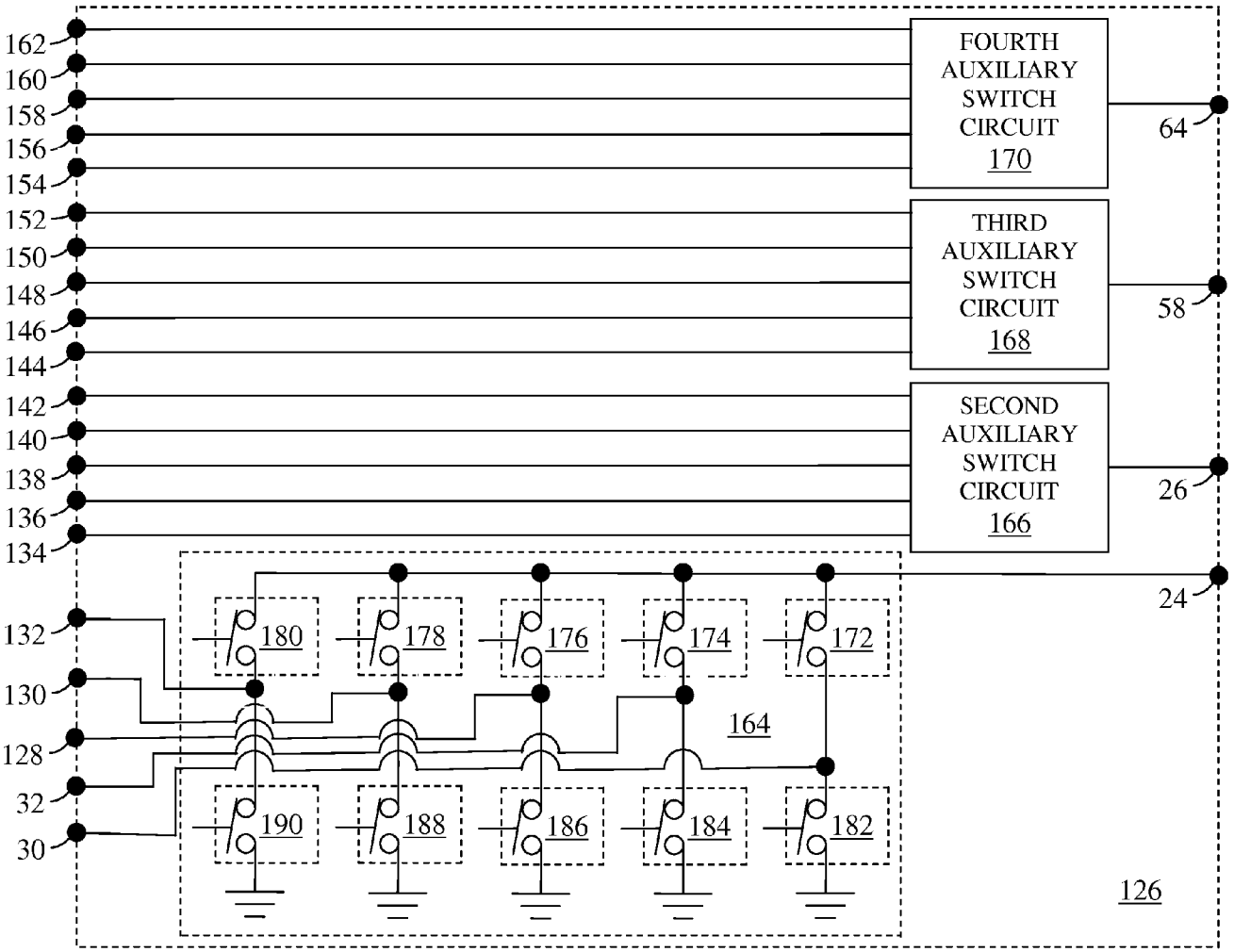
FIG. 12 shows details of auxiliary RF switching circuitry illustrated in FIG. 10 according to one embodiment of the auxiliary RF switching circuitry.

FIG. 12 shows details of the auxiliary RF switching circuitry 126 illustrated in FIG. 11 according to one embodiment of the auxiliary RF switching circuitry 126. The auxiliary RF switching circuitry 126 includes a first auxiliary switch circuit 164, a second auxiliary switch circuit 166, a third auxiliary switch circuit 168, and a fourth auxiliary switch circuit 170.

The second auxiliary switch circuit 166 is coupled between each of the sixth auxiliary RF port 134, the seventh auxiliary RF port 136, the eighth auxiliary RF port 138, the ninth auxiliary RF port 140, and the tenth auxiliary RF port 142; and the second main RF port 26. The third auxiliary switch circuit 168 is coupled between each of the eleventh auxiliary RF port 144, the twelfth auxiliary RF port 146, the thirteenth auxiliary RF port 148, the fourteenth auxiliary RF port 150, and the fifteenth auxiliary RF port 152; and the third main RF port 58. The fourth auxiliary switch circuit 170 is coupled between each of the sixteenth auxiliary RF port 154, the seventeenth auxiliary RF port 156, the eighteenth auxiliary RF port 158, the nineteenth auxiliary RF port 160, and the twentieth auxiliary RF port 162; and the fourth main RF port 64. The auxiliary RF switching circuitry 126 illustrated in FIG. 12 is configured based on the first function configuration signal FCS1.

The first auxiliary switch circuit 164 includes a first auxiliary series switch 172, a second auxiliary series switch 174, a third auxiliary series switch 176, a fourth auxiliary series switch 178, a fifth auxiliary series switch 180, a first auxiliary shunt switch 182, a second auxiliary shunt switch 184, a third auxiliary shunt switch 186, a fourth auxiliary shunt switch 188, and a fifth auxiliary shunt switch 190.

The first auxiliary series switch 172 is coupled between the first main RF port 24 and the first auxiliary RF port 30. The second auxiliary series switch 174 is coupled between the first main RF port 24 and the second auxiliary RF port 32. The third auxiliary series switch 176 is coupled between the first main RF port 24 and the third auxiliary RF port 128. The fourth auxiliary series switch 178 is coupled between the first main RF port 24 and the fourth auxiliary RF port 130. The fifth auxiliary series switch 180 is coupled between the first main RF port 24 and the fifth auxiliary RF port 132.

The first auxiliary shunt switch 182 is coupled between the first auxiliary RF port 30 and the ground. The second auxiliary shunt switch 184 is coupled between the second auxiliary RF port 32 and the ground. The third auxiliary shunt switch 186 is coupled between the third auxiliary RF port 128 and the ground. The fourth auxiliary shunt switch 188 is coupled between the fourth auxiliary RF port 130 and the ground. The fifth auxiliary shunt switch 190 is coupled between the fifth auxiliary RF port 132 and the ground.

Each of the auxiliary series switches 172, 174, 176, 178, 180 and a corresponding each of the auxiliary shunt switches 182, 184, 186, 188, 190 provides a series-shunt architecture. While the series-shunt architecture may not provide as much isolation as the series-shunt-series architectures previously presented, by combining the series-shunt architecture and the series-shunt-series architecture, an effective trade-off between isolation, size, and cost may be reached.

Figure 13:
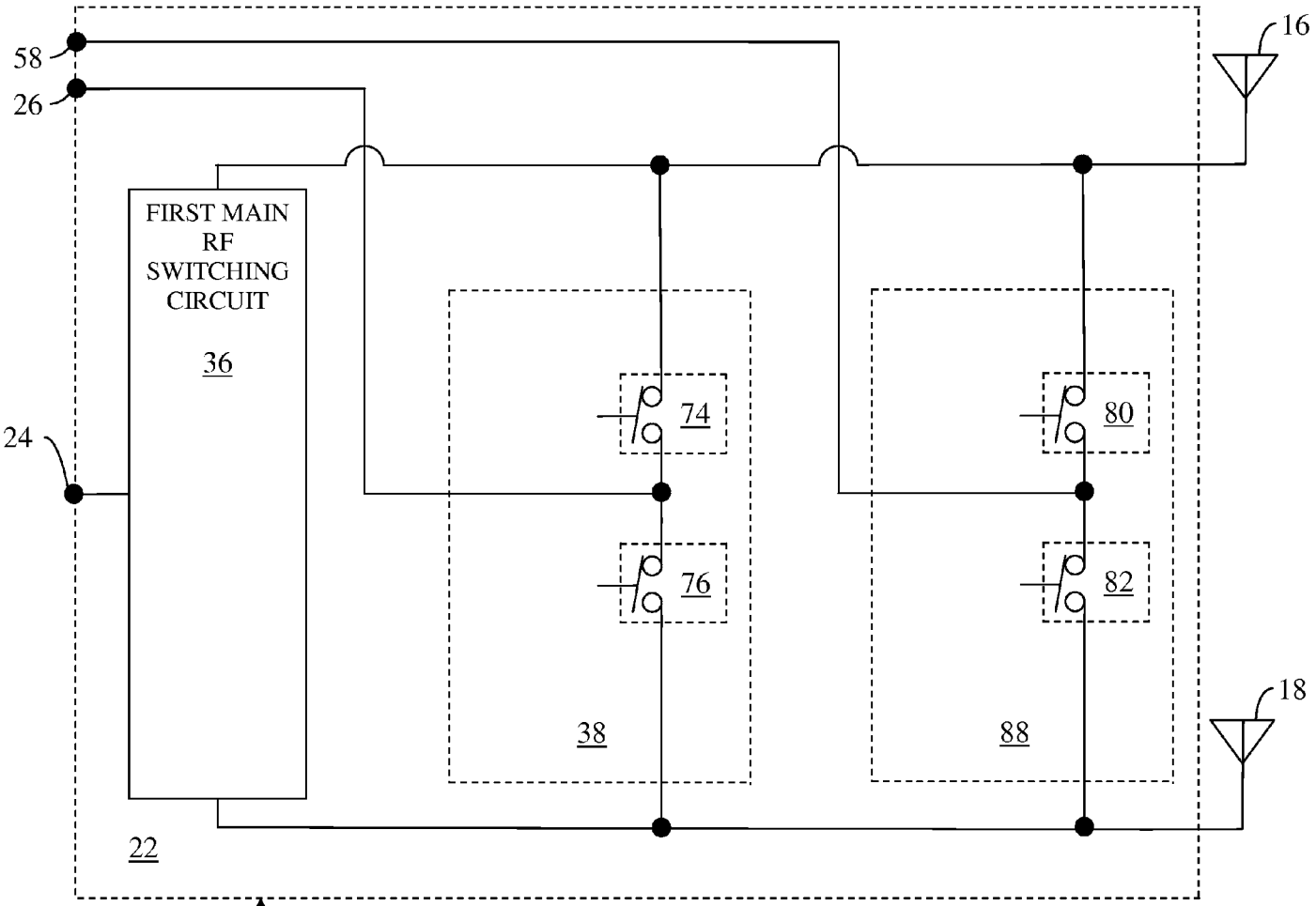
FIG. 13 shows details of the RF switching circuitry illustrated in FIG. 1 according to one embodiment of the RF switching circuitry.

FIG. 13 shows details of the RF switching circuitry 22 illustrated in FIG. 1 according to one embodiment of the RF switching circuitry 22. The RF switching circuitry 22 illustrated in FIG. 13 is similar to the RF switching circuitry 22 illustrated in FIG. 7, except in the RF switching circuitry 22 illustrated in FIG. 13, the second main RF switching circuit 38 includes only the fifth series RF switch 74 and the sixth series RF switch 76; and the third main RF switching circuit 88 includes only the seventh series RF switch 80 and the eighth series RF switch 82. The RF switching circuitry 22 illustrated in FIG. 13 is configured based on the first function configuration signal FCS1.

The fifth series RF switch 74 is coupled between the first RF antenna 16 and the second main RF port 26. The sixth series RF switch 76 is coupled between the second RF antenna 18 and the second main RF port 26. The seventh series RF switch 80 is coupled between the first RF antenna 16 and the third main RF port 58. The eighth series RF switch 82 is coupled between the second RF antenna 18 and the third main RF port 58. In this regard, the fifth series RF switch 74, the sixth series RF switch 76, the seventh series RF switch 80, and the eighth series RF switch 82 provide series only isolation. As such, the series only isolation may typically provide less isolation than the series-shunt-series isolation illustrated in FIGS. 6 and 7. However, if the second main RF switching circuit 38 and the third main RF switching circuit 88 provide routing of RF transmit signals, the reduced insertion loss provided by series only isolation may be proper trade-off.

Figure 14:
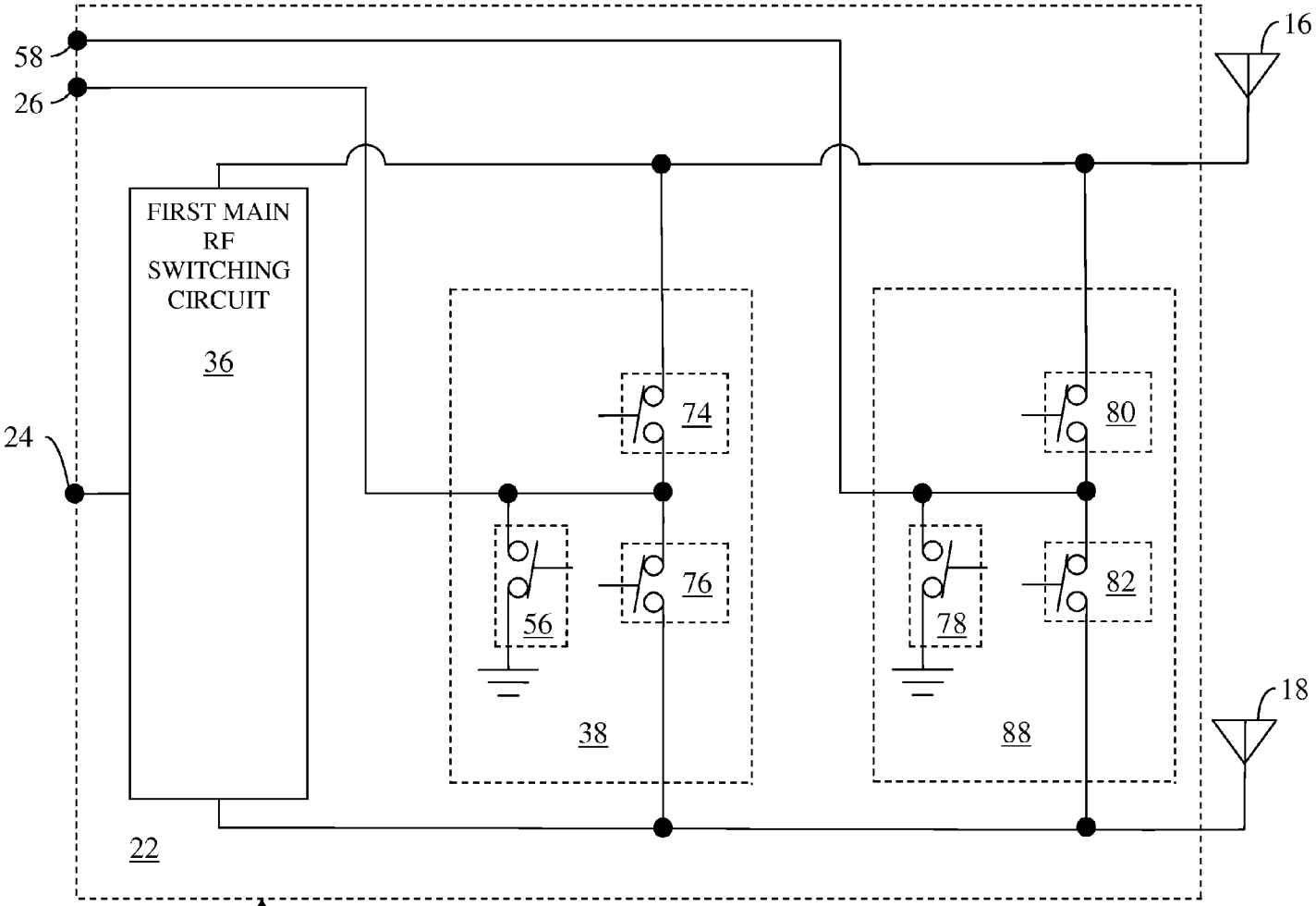
FIG. 14 shows details of the RF switching circuitry illustrated in FIG. 1 according to an alternate embodiment of the RF switching circuitry.

FIG. 14 shows details of the RF switching circuitry 22 illustrated in FIG. 1 according to an alternate embodiment of the RF switching circuitry 22. The RF switching circuitry 22 illustrated in FIG. 14 is similar to the RF switching circuitry 22 illustrated in FIG. 13, except in the RF switching circuitry 22 illustrated in FIG. 14, the second main RF switching circuit 38 further includes the third shunt RF switch 56 coupled between the second main RF port 26 and the ground, and the third main RF switching circuit 88 further includes the fourth shunt RF switch 78 coupled between the third main RF port 58 and the ground. The RF switching circuitry 22 illustrated in FIG. 14 is configured based on the first function configuration signal FCS1.

As a result, the fifth series RF switch 74, the sixth series RF switch 76, the third shunt RF switch 56, the seventh series RF switch 80, the eighth series RF switch 82, and the fourth shunt RF switch 78 provide series-shunt isolation. The series-shunt isolation may provide better isolation than the series only isolation and the series-shunt-series isolation may provide better isolation than the series-shunt isolation. However, different applications may be able to utilize any of these types of isolation depending on the circumstances and the trade-offs involved.

Figures 15A, 15B, 15C, 15D:
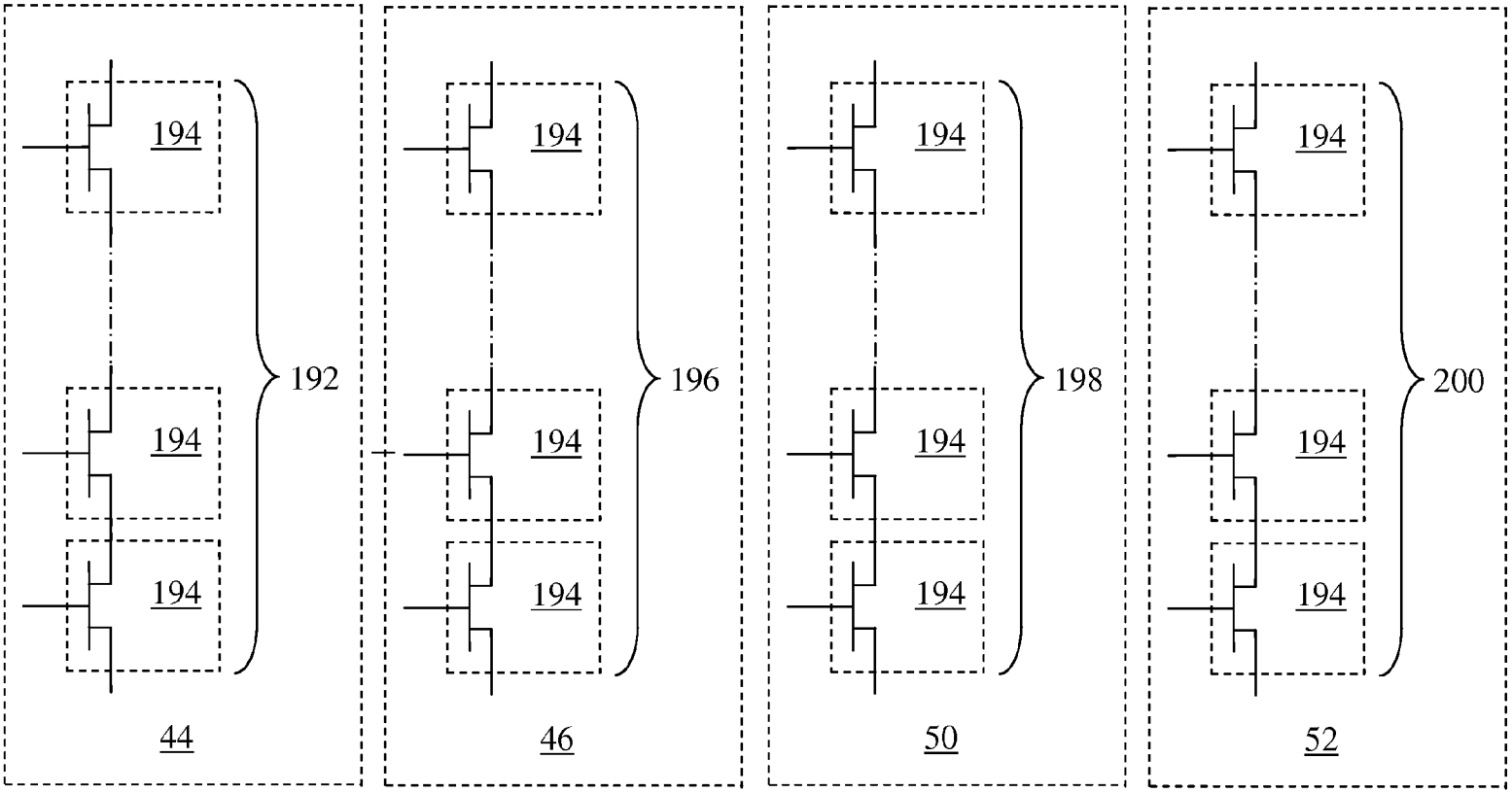
FIGS. 15A, 15B, 15C and 15D show details of a first series RF switch, a second series RF switch, a third series RF switch, and a fourth series RF switch, respectively, illustrated in FIG. 2 according to one embodiment of the first series RF switch, the second series RF switch, the third series RF switch, and the fourth series RF switch.

FIGS. 15A, 15B, 15C and 15D show details of the first series RF switch 44, the second series RF switch 46, the third series RF switch 50, and the fourth series RF switch 52, respectively, illustrated in FIG. 2 according to one embodiment of the first series RF switch 44, the second series RF switch 46, the third series RF switch 50, and the fourth series RF switch 52. As such, FIG. 15A shows details of the first series RF switch 44, which includes a first group 192 of switching transistor elements 194 coupled in series. FIG. 15B shows details of the second series RF switch 46, which includes a second group 196 of switching transistor elements 194 coupled in series. FIG. 15C shows details of the third series RF switch 50, which includes a third group 198 of switching transistor elements 194 coupled in series. FIG. 15D shows details of the fourth series RF switch 52, which includes a fourth group 200 of switching transistor elements 194 coupled in series.

When the first main RF switching circuit 36 must be capable of providing a signal path for both RF transmit signals and RF receive signals, each of the first group 192 of switching transistor elements 194, the second group 196 of switching transistor elements 194, the third group 198 of switching transistor elements 194, and the fourth group 200 of switching transistor elements 194 may include an equal number of switching transistor elements 194.

However, when the first main RF switching circuit 36 is not required to provide a signal path for RF transmit signals, such as during receive only situations, the first series RF switch 44 and the fourth series RF switch 52 will always be OPEN in the presence of RF transmit signals. As a result, the second series RF switch 46 and the third series RF switch 50 will never have to directly block RF transmit signals, thereby placing a reduced power handling burden on the second series RF switch 46 and the third series RF switch 50. In this regard, in one embodiment of the first group 192 of switching transistor elements 194, the second group 196 of switching transistor elements 194, the third group 198 of switching transistor elements 194, and the fourth group 200 of switching transistor elements 194; the first group 192 of switching transistor elements 194 and the fourth group 200 of switching transistor elements 194 each have a larger number of switching transistor elements than each of the second group 196 of switching transistor elements 194 and the third group 198 of switching transistor elements 194.

Those skilled in the art will recognize improvements and modifications to the embodiments of the present disclosure. All such improvements and modifications are considered within the scope of the concepts disclosed herein and the claims that follow.

What is claimed is:

1. An apparatus comprising:

a first main RF switching circuit configured to selectively provide a first RF signal path between a first main RF port and a first RF antenna and selectively provide a second RF signal path between the first main RF port and a second RF antenna; and comprising:

a first pair of RF switches, wherein each of the first pair of RF switches is directly coupled in series with one another between the first RF antenna and the first main RF port;

a second pair of RF switches, wherein each of the second pair of RF switches is directly coupled in series with one another between the second RF antenna and the first main RF port;

a first shunt RF switch coupled between a connection to both of the first pair of RF switches and a ground; and a second shunt RF switch coupled between a connection to both of the second pair of RF switches and the ground; and a second main RF switching circuit configured to selectively provide a third RF signal path between a second main RF port and the first RF antenna and selectively provide a fourth RF signal path between the second main RF port and the second RF antenna.

2. The apparatus of claim 1 wherein the first main RF switching circuit is further configured to selectively provide isolation between the first main RF port and the first RF antenna and selectively provide isolation between the first main port and the second RF antenna.

3. The apparatus of claim 2 wherein the second main RF switching circuit is configured to selectively provide isolation between the second main RF port and the first RF antenna and selectively provide isolation between the second main RF port and the second RF antenna.

4. The apparatus of claim 1 wherein configurations of the first main RF switching circuit and the second main RF switching circuit are based on a first function configuration signal, which is provided by control circuitry.

5. The apparatus of claim 1 wherein the first main RF switching circuit further comprises a third shunt RF switch coupled between the first main RF port and the ground.

6. The apparatus of claim 1 wherein the first main RF switching circuit further comprises a first inner series RF switch coupled between a third main RF port and a connection to all of the first shunt RF switch and the first pair of RF switches.

7. The apparatus of claim 6 wherein the first main RF switching circuit further comprises a second inner series RF switch coupled between the third main RF port and a connection to all of the second shunt RF switch and the second pair of RF switches.

8. The apparatus of claim 1 wherein one of the first pair of RF switches is directly coupled to the first RF antenna and one of the second pair of RF switches is directly coupled to the second RF antenna, such that the one of the first pair of RF switches is configured to be OPEN in a presence of RF transmit signals being provided to the first RF antenna, and the one of the second pair of RF switches is configured to be OPEN in a presence of RF transmit signals being provided to the second RF antenna.

9. The apparatus of claim 8 wherein the one of the first pair of RF switches comprises a first plurality of switching transistor elements coupled in series; another of the first pair of RF switches comprises a second plurality of switching transistor elements coupled in series; the one of the second pair of RF switches comprises a third plurality of switching transistor elements coupled in series; and another of the second pair of RF switches comprises a fourth plurality of switching transistor elements coupled in series, such that a quantity of the first plurality is greater than a quantity of the second plurality and a quantity of the third plurality is greater than a quantity of the fourth plurality.

10. The apparatus of claim 1 further comprising a first auxiliary switch circuit coupled to the first main RF port.

11. The apparatus of claim 1 wherein the second main RF switching circuit comprises a third pair of RF switches and a fourth pair of RF switches, such that the third pair of RF switches is coupled in series between the first RF antenna and the second main RF port; and the fourth pair of RF switches is coupled in series between the second RF antenna and the second main RF port.

12. The apparatus of claim 11 further comprising a first auxiliary switch circuit and a second auxiliary switch circuit, such that the first auxiliary switch circuit is coupled to the first main RF port and the second auxiliary switch circuit is coupled to the second main RF port.

13. The apparatus of claim 11 further comprising a third main RF switching circuit, which comprises a fifth pair of RF switches and a sixth pair of RF switches, wherein the fifth pair of RF switches is coupled in series between the first RF antenna and a third main RF port; and the sixth pair of RF switches is coupled in series between the second RF antenna and the third main RF port.

14. The apparatus of claim 13 further comprising a first auxiliary switch circuit, a second auxiliary switch circuit, and a third auxiliary switch circuit, such that the first auxiliary switch circuit is coupled to the first main RF port, the second auxiliary switch circuit is coupled to the second main RF port, and the third auxiliary switch circuit is coupled to the third main RF port.

15. The apparatus of claim 1 wherein the second main RF switching circuit comprises a first series RF switch and a second series RF switch, wherein the first series RF switch is coupled between the first RF antenna and the second main RF port; and the second series RF switch is coupled between the second RF antenna and the second main RF port.

16. The apparatus of claim 15 wherein the second main RF switching circuit further comprises a third shunt RF switch coupled between the second main RF port and the ground.

17. The apparatus of claim 15 further comprising a third main RF switching circuit, which comprises a third series RF switch and a fourth series RF switch, wherein the third series RF switch is coupled between the first RF antenna and a third main RF port; and the fourth series RF switch is coupled between the second RF antenna and the third main RF port.

18. The apparatus of claim 17 wherein the second main RF switching circuit further comprises a third shunt RF switch coupled between the second main RF port and the ground; and the third main RF switching circuit further comprises a fourth shunt RF switch coupled between the third main RF port and the ground.

19. The apparatus of claim 1 further comprising a third main RF switching circuit, wherein:

the second main RF switching circuit comprises a third pair of RF switches a fourth pair of RF switches, a third shunt RF switch, and a fourth shunt RF switch, such that the third pair of RF switches is coupled in series between the first RF antenna and the second main RF port; the fourth pair of RF switches is coupled in series between the second RF antenna and the second main RF port; the third shunt RF switch is coupled between a connection to both of the third pair of RF switches and the ground; and the fourth shunt RF switch is coupled between a connection to both of the fourth pair of RF switches and the ground; and the third main RF switching circuit comprises a first series RF switch and a second series RF switch, wherein the first series RF switch is coupled between the first RF antenna and a third main RF port; and the second series RF switch is coupled between the second RF antenna and the third main RF port.

20. The apparatus of claim 1 further comprising a third main RF switching circuit configured to selectively provide an RF signal path between a third main RF port and a third selected one of the first RF antenna and the second RF antenna.

21. The apparatus of claim 20 further comprising a fourth main RF switching circuit configured to selectively provide an RF signal path between a fourth main RF port and a fourth selected one of the first RF antenna and the second RF antenna.

* * * * *